US007812807B2

(12) United States Patent
Yano et al.

(10) Patent No.: US 7,812,807 B2
(45) Date of Patent: Oct. 12, 2010

(54) DISPLAY DEVICE AND DRIVING DEVICE

(75) Inventors: Takeshi Yano, Nara (JP); Hiroaki Fujino, Kyoto (JP); Michihiro Nakahara, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 988 days.

(21) Appl. No.: 11/091,569

(22) Filed: Mar. 29, 2005

(65) Prior Publication Data

US 2005/0219195 A1 Oct. 6, 2005

(30) Foreign Application Priority Data

Mar. 30, 2004 (JP) ..... 2004-099939

(51) Int. Cl.
*G09G 3/36* (2006.01)

(52) U.S. Cl. ..... 345/99; 345/96; 345/100

(58) Field of Classification Search ..... 345/96, 345/204, 98–100
See application file for complete search history.

(56) References Cited

U.S. PATENT DOCUMENTS

| | | | | |
|---|---|---|---|---|
| 5,402,255 | A | 3/1995 | Nakanishi et al. | |
| 5,903,234 | A | 5/1999 | Kimura | |
| 5,959,916 | A | 9/1999 | Kumar | |
| 6,232,948 | B1 | 5/2001 | Tsuchi | |
| 6,366,065 | B1 | 4/2002 | Morita | |
| 6,396,485 | B1 | 5/2002 | Minami | |
| 6,529,180 | B1 | 3/2003 | Ito et al. | |
| 6,570,418 | B2 * | 5/2003 | Uehara | 327/141 |
| 6,642,916 | B1 | 11/2003 | Kodama et al. | |
| 2002/0008687 | A1 * | 1/2002 | Tazuke | 345/96 |
| 2002/0050972 | A1 * | 5/2002 | Udo et al. | 345/96 |
| 2002/0105492 | A1 | 8/2002 | Kosaka | |
| 2003/0006997 | A1 | 1/2003 | Ogawa et al. | |
| 2003/0107541 | A1 * | 6/2003 | Naiki | 345/87 |
| 2003/0132903 | A1 | 7/2003 | Ueda | |
| 2004/0041763 | A1 | 3/2004 | Kodama et al. | |
| 2004/0041826 | A1 | 3/2004 | Nakagawa et al. | |

FOREIGN PATENT DOCUMENTS

| | | |
|---|---|---|
| JP | 10-11032 | 1/1989 |
| JP | 04-358197 | 12/1992 |
| JP | 07-199866 | 4/1995 |

(Continued)

*Primary Examiner*—Amr Awad
*Assistant Examiner*—Michael Pervan
(74) *Attorney, Agent, or Firm*—Harness, Dickey & Pierce, P.L.C.

(57) ABSTRACT

A driving device includes (i) a switching circuit, which carries out precharging by (a) separating an outputting circuit from source signal lines, and (b) short-circuiting at least one source signal line whose source signal potential is positive in a certain horizontal period and at least one source signal line whose source signal potential is negative in the certain horizontal period and (ii) a pulse width adjusting circuit which adjusts timings. Therefore, it is possible to carry out a charge sharing without additionally providing an external memory capacitor. On this account, even when a newly designed display section (liquid crystal panel, etc.), which is different in the number of pixels and materials from a conventional display section, is used, it is possible to realize a display device and a driving device which do not require the change in the arrangement of the controller.

15 Claims, 20 Drawing Sheets

FOREIGN PATENT DOCUMENTS

| | | |
|---|---|---|
| JP | 07-199866 | 8/1995 |
| JP | 08-076083 | 3/1996 |
| JP | 09-212137 | 8/1997 |
| JP | 09-243998 | 9/1997 |
| JP | 10-115839 | 5/1998 |
| JP | 10-133174 | 5/1998 |
| JP | 10-301537 | 11/1998 |
| JP | 10-301539 | 11/1998 |
| JP | 11-30975 | 2/1999 |
| JP | 11-264965 | 9/1999 |
| JP | 11-326863 | 11/1999 |
| JP | 2001-22328 | 1/2001 |
| JP | 2001-134245 | 5/2001 |
| JP | 2001-166731 | 6/2001 |
| JP | 2001-188615 | 7/2001 |
| JP | 2002-229525 | 8/2002 |
| JP | 2003-131634 | 5/2003 |
| JP | 2003-248466 | 9/2003 |
| JP | 2004-93691 | 3/2004 |
| KR | 10-2004-0078258 | 9/2004 |
| TW | 416054 | 12/2000 |
| TW | 594645 | 6/2004 |
| WO | WO 96/06421 | 2/1996 |

* cited by examiner

DISPLAY DEVICE AND DRIVING DEVICE

This Nonprovisional application claims priority under 35 U.S.C. §119(a) on Patent Application No. 2004/99939 filed in Japan on Mar. 30, 2004, the entire contents of which are hereby incorporated by reference.

FIELD OF THE INVENTION

The present invention relates to a driving device of a display device such as a liquid crystal display device, and particularly to a driving device of a display device such as an active matrix liquid crystal display device, and the display device.

BACKGROUND OF THE INVENTION

One example of liquid crystal display devices is disclosed in Japanese Patent No. 2,837,027 (published on Dec. 14, 1998, corresponding U.S. Pat. No. 5,402,255).

FIGS. 18, 19 and 20 illustrate how input/output signals are exchanged between driver ICs in the conventional liquid crystal display device. For example, driver ICs are usually connected via a substrate (Printed Wired Board, PWB) as illustrated in FIG. 20.

FIG. 18 illustrates a TCP of the conventional driver IC. An input/output signal external connection terminal section 51, which is commonly used by a plurality of driver ICs, is provided on a lower side (on the side opposite to a liquid crystal drive output external connection terminal section 55 is provided) of the TCP (Tape Carrier Package). The input/output signal external connection terminal section 51 and connection lead terminals of PWBs 71, 72 and 75 are connected by soldering. In this way, the connection for the input/output signals is realized between the driver ICs.

The TCP includes (i) a driver chip 57 substantially at the center, (ii) the liquid crystal drive output external connection terminal section 55 at the upper side, (iii) the input/output signal external connection terminal section 51 (commonly used by a plurality of driver ICs) at the lower side and (iv) terminals S1 to S7 which come out from the lower side.

The chip portion is covered with a resin so as to be protected electrically and physically. Generally, the liquid crystal drive output external connection terminal section 55 is connected to the liquid crystal panel via an anisotropic conductive sheet. On the input/output signal external connection terminal section 51, slits are formed by cutting out the TCP. Then, by connecting the input/output signal external connection terminal section 51 with PWB, it becomes possible to commonly supply a signal to a plurality of driver ICs.

FIG. 19 is an enlarged view of a portion where the driver chip 57 is connected with the TCP. Pads 67 on the driver chip 57 and inner leads 64 at the center of the TCP are thermo-compression-bonded with each other, so as to be electrically and physically connected with each other.

In this arrangement, the terminals S1 to S7 of the input/output signal external connection terminal section 51 are provided so that one terminal corresponds to one signal. Naturally, one pad corresponds to one signal.

FIG. 20 is a diagram illustrating an arrangement of a conventional liquid crystal module. Assuming that the liquid crystal panel illustrated in FIG. 20 is a 640 (transverse direction)×480 (longitudinal direction) dot panel, each of eight source drivers (four at an upper side, and another four at a lower side) have 160 outputs for driving liquid crystal, and each of four common drivers provided on a left side have 120 outputs for driving liquid crystal.

The following description explains a basic principle of how the liquid crystal is driven by the liquid crystal driving device in reference to FIGS. 21 to 24. FIG. 21 is a diagram illustrating a basic principle of how the liquid crystal is driven. Liquid crystal deteriorates when an electric field is continuously applied thereto in one direction for a long period of time, because of its electrochemical property. Therefore, as illustrated in FIGS. 21(*a*) and 21(*b*), it is necessary to reverse, from period to period, the direction of the electric field applied to the liquid crystal.

In addition to the above inversion driving per period, there is an inversion driving per dot of a panel as a method of applying the electric field to a liquid crystal panel. FIGS. 22(*a*) to 24(*b*) illustrate various methods of the inversion driving. ● and ○ are dots to each of which the electric field is applied, but the directions thereof are opposite to each other. Each of FIGS. 21(*a*), 22(*a*) and 23(*a*) illustrates a state in a certain vertical period, and each of FIGS. 21(*b*), 22(*b*) and 23(*b*) illustrates a state in the following vertical period. FIGS. 22(*a*) and 22(*b*) illustrate a case in which all the dots are inverted at the same time per frame. FIGS. 23(*a*) and 23(*b*) illustrate a case in which the dots are inverted per line in a display perpendicular direction (line inversion driving), and the dot are also inverted per frame. FIGS. 24(*a*) and 24(*b*) illustrate a case in which, in addition to the case of FIG. 23, the dots are inverted per dot in a horizontal direction (dot inversion driving).

The above cases are different from each other in ease of building a display system and in image quality. The driving method of FIG. 24 can produce images with the highest quality. The driving method of FIG. 24 is disclosed, for example, in International Publication WO96/06421 (published on Feb. 29, 1996).

FIG. 25 is a block diagram illustrating an arrangement of a driving device, which adopts the dot inversion driving of FIG. 24 disclosed in International Publication WO96/06421.

In the driving device adopting the dot inversion driving, a plurality of operational amplifiers 76 are provided. To an output terminal of each of the operational amplifiers 76, two switching elements 102 and 104 are connected. These two switching elements 102 and 104 are formed by the first and second MOS transistors, respectively. Drain terminals 96 of the switching elements 102 and 104 are connected to a load capacitance C2.

A gate terminal of the first switching element 102 is coupled with a SELECT signal, and a gate terminal of the second switching element 104 is coupled with a complementary SELECT signal (an inversion signal of the SELECT signal).

A source terminal of the first switching element 102 is coupled with an external memory capacitor 66, and a source terminal 65 of the second switching element 104 is coupled with an output of the operational amplifier 76. When the SELECT signal is high, the switching element 102 is turned on, and the switching element 104 is turned off. When the SELECT signal is low, the switching element 102 is turned off, and the switching element 104 is turned on.

The external memory capacitor is provided for carrying out a charge sharing. The charge sharing is one type of precharging. That is, by utilizing the electric charge remaining in the source signal lines in a certain horizontal period, the precharging of the source signal lines is carried out in the following horizontal periods. As for the precharging, before the potential of the source signal line is set to the source signal potential for the horizontal period, a voltage is applied to the source signal line in advance. An object of this voltage application is to cause the source signal line to reach a desired source signal potential as quickly as possible.

In FIG. 25, a value of the external memory capacitor 66 is selected so that the value of the external memory capacitor 66 is much larger than N times of the value of the load capacitance C2. Note that, N is the number of source signal lines in an arrangement of pixels, and C2 is the load capacitance typically connected with one source signal line in the arrangement of pixels. During the first portion of the horizontal period, the electric charge accumulated on the load capacitance C2 is discharged to the external memory capacitor 66. The external memory capacitor 66 acts as a large-size electric charge sink. In the line inversion driving, each source driver needs to apply high and low voltages alternately in each horizontal period.

In the line inversion driving, voltages are not randomly applied (that is, the applied voltage is not unknown in each horizontal period), but polarities of the voltages regularly shift in the horizontal period. On this account, energy for switching a load capacitance to be high is used for switching a next load capacitance to be low. Therefore, it is possible to decrease a voltage newly applied at the beginning of the horizontal period.

Adversely, energy for switching a load capacitance to be low is used for switching a next load capacitance to be high. Therefore, it is possible to decrease a voltage newly applied at the beginning of the horizontal period.

The external memory capacitor 66 time-averages voltages applied to the source signal lines. In the line inversion driving, an average voltage charged on the external memory capacitor 66 is a bias voltage between a maximum positive voltage and a minimum negative voltage (whose absolute value is maximum) applied to the source signal line. For example, when the maximum positive voltage is 6 V and the minimum negative voltage is −6 V, the bias voltage is 0 V. Therefore, the external memory capacitor is 0 V or close to 0 V.

The external memory capacitor 66 is connected between a common line (not illustrate) and a bias voltage source which is at a ground potential in this case.

In the driving device illustrated in FIG. 25, when the SELECT signal is high, the switching element is turned on, and the switching element 104 is turned off.

Therefore, when the SELECT signal is high, a plurality of switching elements 102 are turned on at the same time, and are connected to the external memory capacitor 66 provided externally. The external memory capacitor 66 then carries out the charge sharing so that the electric power charged to the load capacitance 96 from the output of the operational amplifier 76 is collected or discharged to the external memory capacitor 66.

Liquid crystal display devices have been developed in order to meet the demand of increasing the size of the screen for use in TVs, PCs, etc. Moreover, mid-size and small-size liquid crystal display devices and liquid crystal driving devices are developed for use in mobile terminals, such as mobile phones which are rapidly expanding its market in recent years.

For the screens of the liquid crystal display devices used for the above purposes, the liquid crystal driving devices are strongly desired to be small, be light, support many outputs, be high in speed, be low in cost, be high in display quality, and be low in power consumption (including a case of battery-driven).

However, because the number of pixels and the materials are different between a newly designed liquid crystal panel and a conventional liquid crystal panel, load capacitances and the like are also different between them, and hence external memory capacitors required for adequately carrying out the charge sharing are also different between them. On this account, in order to obtain the effect equivalent to that of the charge sharing of the conventional liquid crystal display device by using the newly designed liquid crystal display device, it is necessary, in the conventional technology, to adjust the timing of the pulse width (high period) of SELECT signal outputted from a controller so that an outputted driving voltage temporarily gets close to a medium driving voltage. For this, it becomes necessary to arrange a new controller.

SUMMARY OF THE INVENTION

The present invention was made to solve the above problems, and an object of the present invention is to realize a display device and a driving device which do not require the change in the arrangement of the controller, even when a newly designed display section (liquid crystal panel, etc.), which is different in the number of pixels and materials, is used.

In order to solve the above problems, the driving device of the present invention drives a display section of a display device by applying, in each horizontal period, voltages to pixels in the display section through source signal lines charged to have source signal potentials according to display data signals supplied from an outputting circuit, the driving device precharging the source signal lines before causing the source signal lines to have the source signal potentials for the above each horizontal period, and the driving device comprises: a switching circuit which (a) separates the outputting circuit from the source signal lines and (b) short-circuits at least one source signal line whose source signal potential is positive in one horizontal period and at least one source signal line whose source signal potential is negative in the above one horizontal period, so that the short-circuited source signal lines are precharged.

According to the above arrangement, the precharging is carried out by short-circuiting (i) at least one source signal line whose source signal potential is positive and (ii) at least one source signal line whose source signal potential is negative in the same horizontal period.

In this way, the precharging is completed by short-circuiting the source signal lines with each other inside the display section. Therefore, the external memory capacitor is unnecessary, and the adjustment of the external memory capacitor is obviously unnecessary. As a result, it is unnecessary to change or adjust the timing of the pulse width (high period) of the SELECT signal outputted from the controller. Therefore, it is unnecessary to renew the arrangement of the controller.

On this account, even when a newly designed display section (liquid crystal panel, etc.), which is different in the number of pixels and materials, is used, it is possible to realize a display device and a driving device which do not require the change in the arrangement of the controller.

Additional objects, features, and strengths of the present invention will be made clear by the description below. Further, the advantages of the present invention will be evident from the following explanation in reference to the drawings.

DESCRIPTION OF THE EMBODIMENTS

Embodiment 1

The following description explains one embodiment of the present invention in reference to FIGS. 1 to 11.

The present embodiment takes a liquid crystal display device as an example of a display device. That is, the present embodiment takes a liquid crystal driving device as an example of a driving device.

Figure 1:
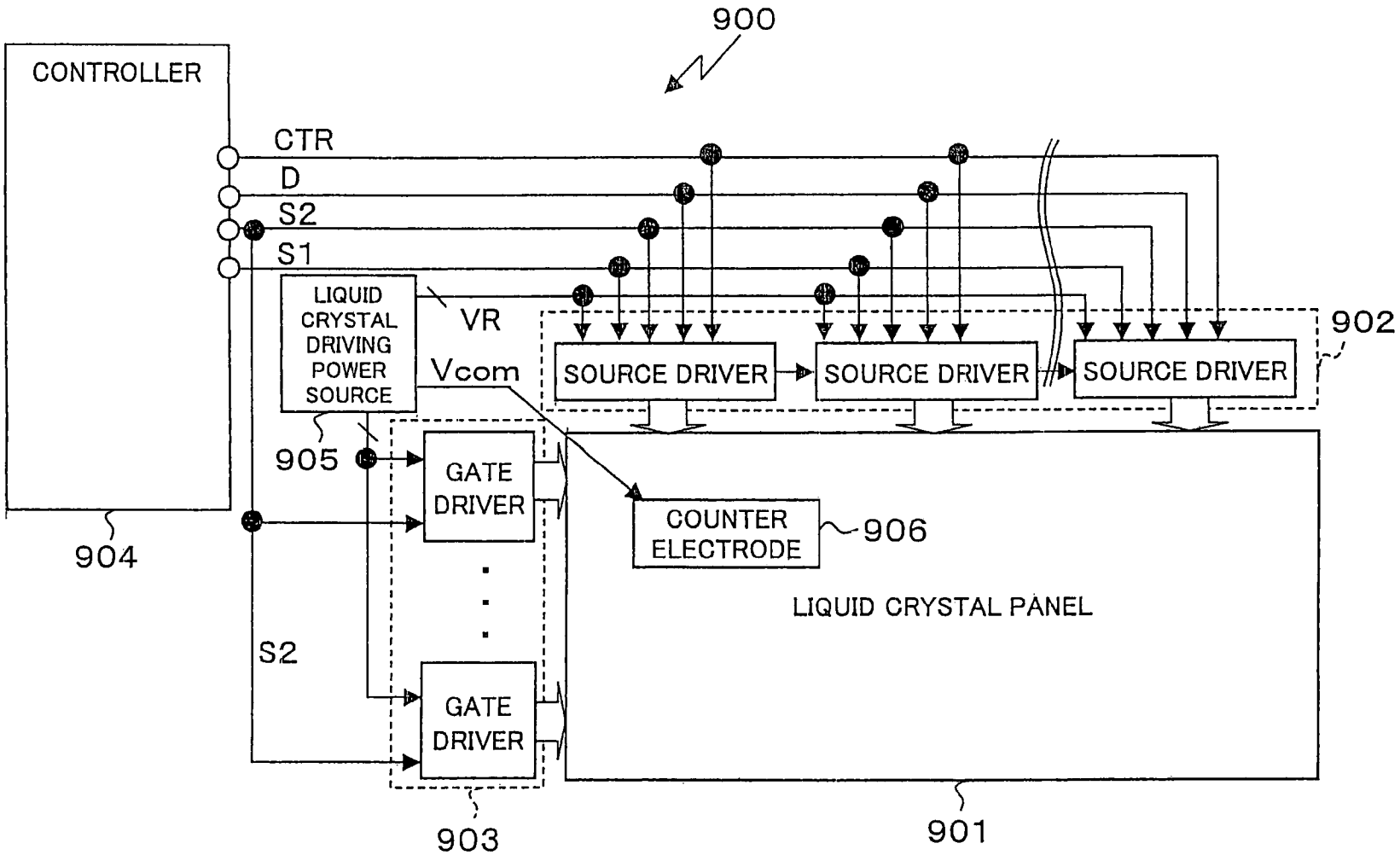
FIG. 1 Conventional Art
FIG. 1 is a block diagram illustrating an example of an arrangement of a TFT (Thin Film Transistor) liquid crystal display device, which is one of the typical examples of the active matrix liquid crystal display devices.

FIG. 1 is a block configuration of a TFT (Thin Film Transistor) liquid crystal display device which is one of the typical examples of the active matrix liquid crystal display devices.

Here, in the same horizontal period, some source signal lines have positive source signal potentials, while other source signal lines have negative potentials (that is, a dot inversion driving is basically performed).

Here, each of the source signal lines has a load capacitance. The load capacitance is a capacitance of load relative to the source signal lines. The load capacitance includes a capacitance of the source signal line itself and a pixel capacitance of a pixel of a selected line (in a direction along gate signal lines).

A liquid crystal display device 900 includes a liquid crystal display section (display section) and a liquid crystal driving device (driving device) which drives the liquid crystal display section.

The liquid crystal display section includes a TFT liquid crystal panel 901. In the liquid crystal panel 901, liquid crystal display elements (not illustrated) and a counter electrode (common electrode) 906 are provided.

Meanwhile, the liquid crystal driving device includes source drivers 902 each of which also includes an IC (Integrated Circuit), gate drivers 903 each of which is also composed of an IC (Integrated Circuit), a controller 904 and a liquid crystal driving power source 905.

Generally, each of the source drivers 902 and the gate drivers 903 is arranged in such a manner that (i) a TCP (Tape Carrier Package), formed by mounting an IC chip on a film having wirings, is mounted and connected to an ITO (Indium Tin Oxide, Indium Tin Oxide Film) terminal of a liquid crystal panel or (ii) thermocompression bonding is carried out so that an IC chip is mounted and connected to an ITO terminal of a liquid crystal panel via ACF (Anisotropic Conductive Film).

The controller 904 outputs sets of digitalized display data (for example, the sets of data are respectively R, G, and B signals corresponding to red, green and blue, respectively) and various control signals to the source drivers 902. Moreover, the controller 904 also outputs various control signals to the gate drivers 903. The control signals outputted to the source drivers 902 are mainly a horizontal synchronization signal, a start pulse signal, a clock signal for the source drivers, etc., which are indicated by S1 in FIG. 1. Meanwhile, the control signals outputted to the gate drivers 903 are mainly a vertical synchronization signal, a clock signal for the gate drivers, etc., which are indicated by S2 in FIG. 1. Note that, a power source for driving each IC is not illustrated in FIG. 1.

The liquid crystal driving power source 905 supplies a voltage for the liquid crystal panel display (in the present invention, a reference voltage for generating a voltage for displaying gradations) to the source drivers 902 and the gate drivers 903.

The sets of the display data supplied from the outside are inputted as a set of display data D (digital signals) to the source drivers 902 via the controller 904.

Each of the source drivers 902 internally latches the set of the inputted digitalized display data D in a time-division manner. Then, the source driver 902 performs DA (Digital-Analog) conversion in synchronism with the horizontal synchronization signal (also referred to as "latch signal LS" (see FIG. 5)) inputted from the controller 904. Next, the source driver 902 outputs analog voltages (gradation displaying voltages) from liquid crystal driving voltage outputting terminals via source signal lines 1004 (will be described later) to the liquid crystal display elements (not illustrated) in the liquid crystal panel 901. Note that, the analog voltages are obtained by the DA conversion for displaying gradations, and the liquid crystal display elements correspond to the liquid crystal driving voltage outputting terminals.

Figure 2:
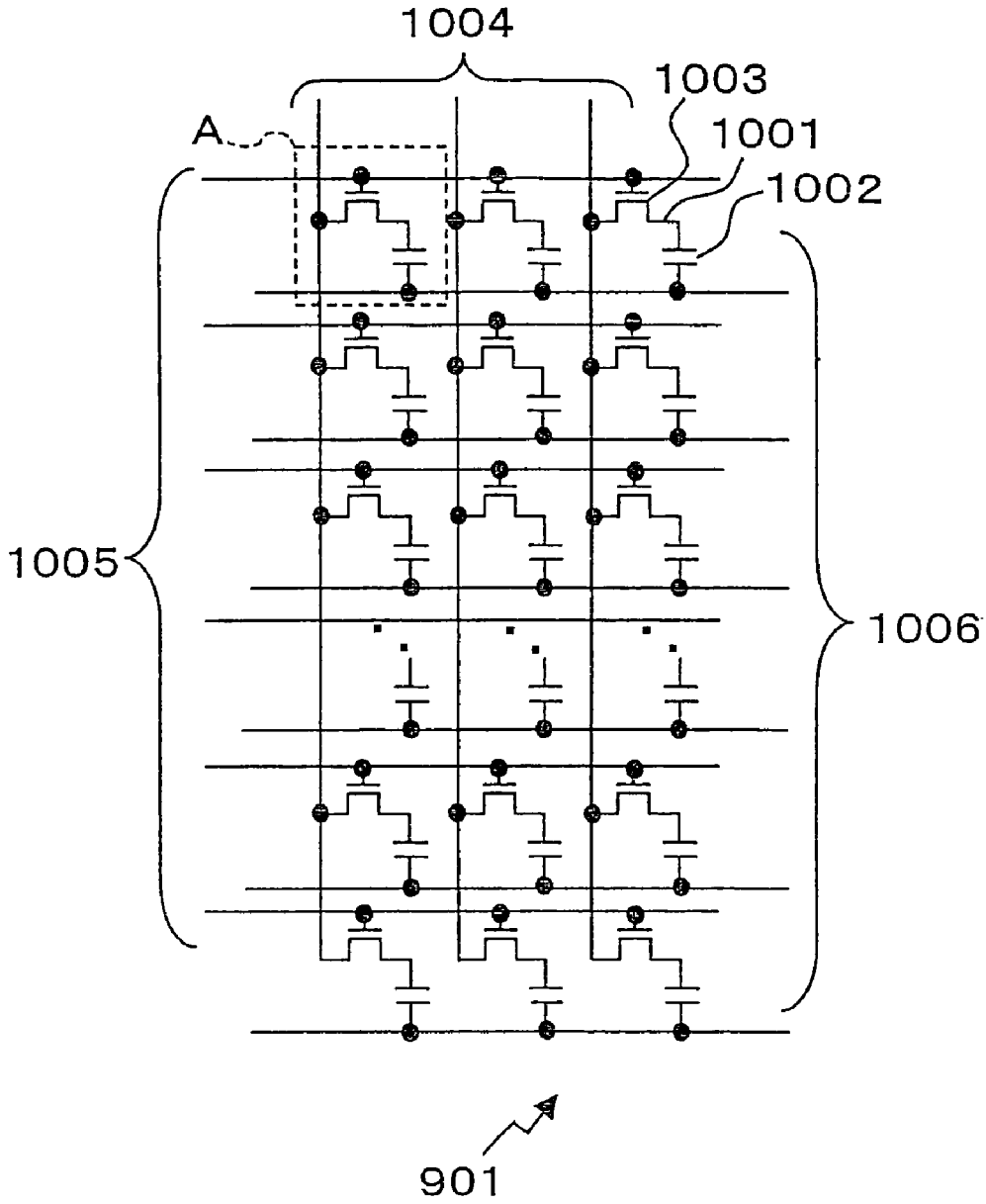
FIG. 2 Conventional Art
FIG. 2 is a circuit diagram illustrating an example of an arrangement of a liquid crystal panel illustrated in FIG. 1.

The following description explains the liquid crystal display panel 901. FIG. 2 illustrates an arrangement of the liquid crystal panel 901. The liquid crystal panel 901 includes pixel electrodes 1001, pixel capacitances 1002, TFTs 1003 as elements each of which controls ON/OFF of a voltage applied to the pixel, source signal lines 1004, gate signal lines 1005 and a counter electrode 1006 (corresponding to the counter electrode 906 in FIG. 1) of the liquid crystal panel. The region A in FIG. 2 is a liquid crystal display element of one pixel.

To the source signal lines 1004, the gradation displaying voltages corresponding to brightness of pixels for displaying images are applied from the source drivers 902. To the gate signal lines 1005, scanning signals for sequentially turning on TFTs 1003 lined up in a column direction are inputted from the gate drivers 903. The voltages of the source signal lines 1004 are applied via TFTs 1003 in an ON state to the pixel electrodes 1001 connected to drains of the TFTs 1003, so that the pixel capacitances 1002 provided between the pixel electrodes 1001 and the counter electrode 1006 are charged. Thus, the optical transmittance of liquid crystal is changed, so that the displaying is carried out.

Figure 3:
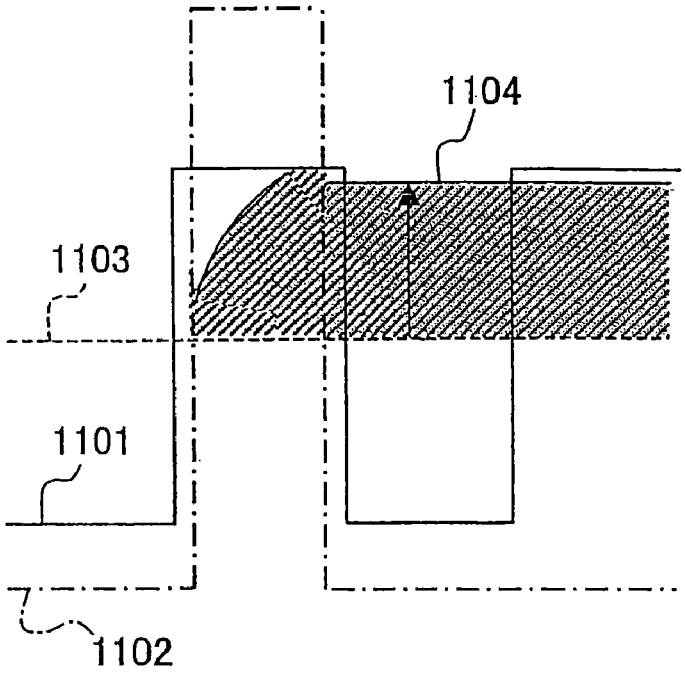
FIG. 3 Conventional Art
FIG. 3 is a diagram illustrating one example of drive waveforms.
Figure 4:
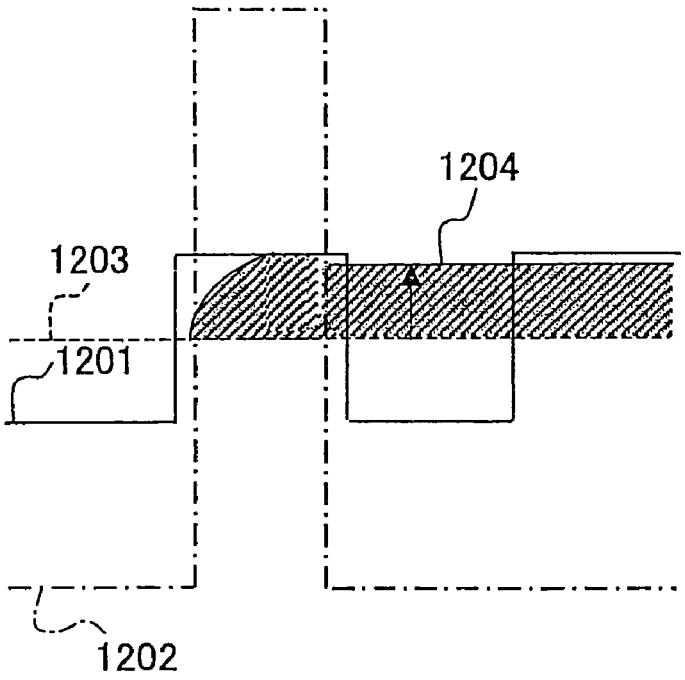
FIG. 4 Conventional Art
FIG. 4 is a diagram illustrating another example of the drive waveforms.

Each of FIGS. 3 and 4 illustrates one example of liquid crystal drive waveforms. In FIGS. 3 and 4, reference numerals 1101 and 1201 are drive waveforms of output signals (source signal potentials) from the source drivers 902, reference numerals 1102 and 1202 are drive waveforms of output signals from the gate drivers 903, reference numerals 1103 and 1203 are potentials of the counter electrode 1006, and reference numerals 1104 and 1204 are voltage waveforms of the pixel electrodes 1001. A voltage applied to the liquid crystal is equivalent to a potential difference (display voltage) between the pixel electrodes 1001 and the counter electrode 1006. The potential difference is illustrated by slant lines in FIGS. 3 and 4.

For example, in FIG. 3, when the output signal, shown by the drive waveform 1102, from the gate driver 903 is a high level, the TFT 1003 is turned on. Then, the difference between the output signal (source signal potential), shown by the drive waveform 1101, from the source driver 902 and the potential 1103 of the counter electrode 1006 is applied to the pixel electrode 1001. After that, as shown by the drive waveform 1102, the output signal from the gate driver 903 becomes a low level, so that TFT 1003 becomes an OFF state.

At this moment, the above-described voltage is held because of the pixel capacitance 1002 in the pixel. This is substantially the same as the case of FIG. 4.

The difference between FIG. 3 and FIG. 4 is a voltage applied to the liquid crystal. An applied voltage of FIG. 4 is lower than that of FIG. 3. Thus, by changing the voltages applied to the liquid crystal into the analog voltages, analog change is caused for the optical transmittance of the liquid crystal, so that the gradation displaying is carried out. The number of displayable gradations depends on the number of choices of the analog voltages applied to the liquid crystal.

Figure 5:
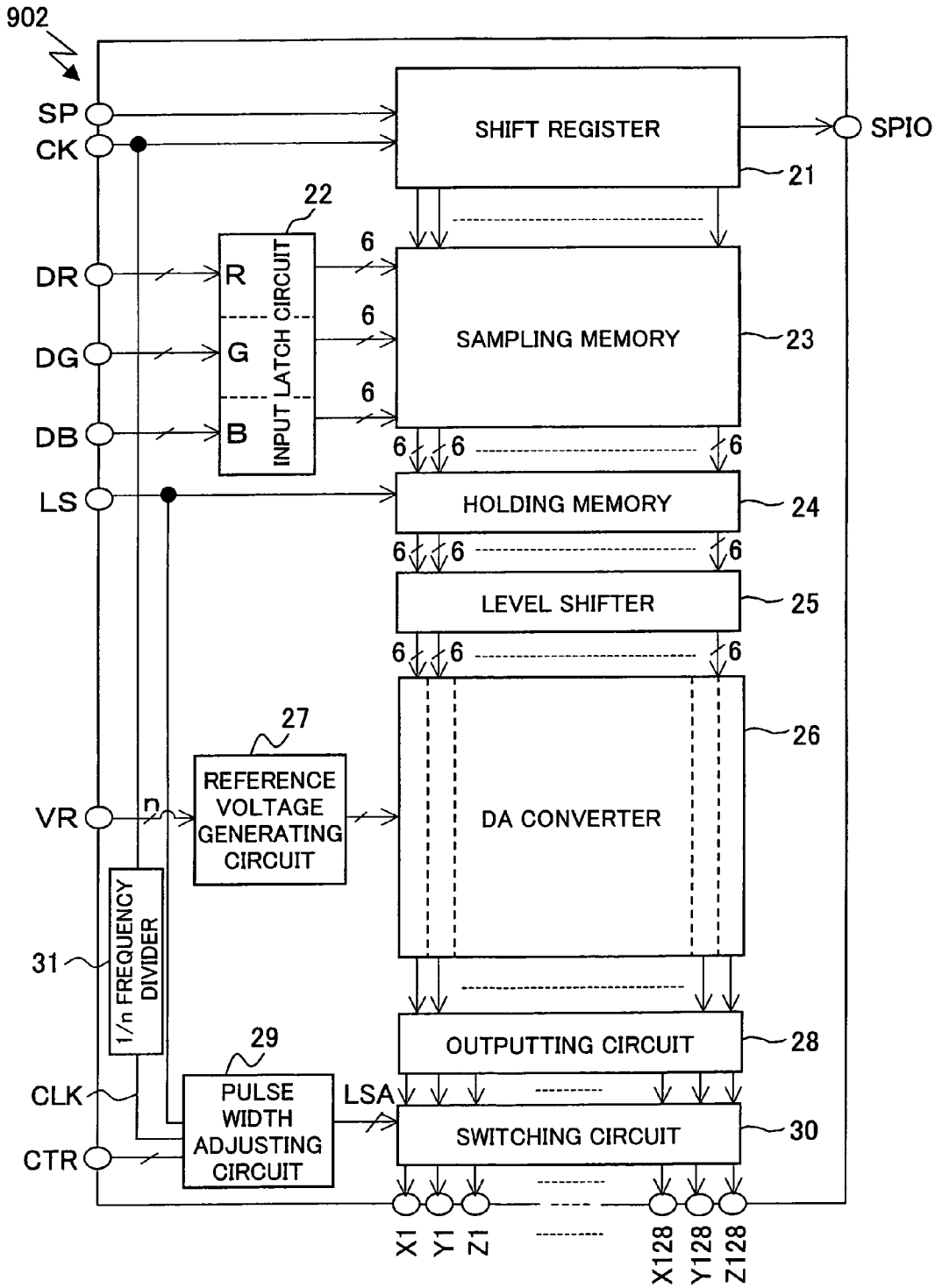
FIG. 5 is a block diagram illustrating an example of an arrangement of a source driver in accordance with the present invention.

FIG. 5 illustrates a block configuration of the source driver 902. The following description explains only fundamental portions. As illustrated in FIG. 5, the source driver 902 includes a shift register 21, an input latch circuit 22, a sampling memory 23, a holding memory 24, a level shifter 25, a DA converter 26, a reference voltage generating circuit 27, an outputting circuit 28, a pulse width adjusting circuit (a timing adjusting circuit) 29, a switching circuit 30 and a 1/n frequency divider 31.

The shift register 21 carries out shifting of an inputted start pulse SP in synchronism with an inputted clock signal CK. From each stage of the shift register 21, a control signal is outputted to the sampling memory 23. Note that, the start pulse SP is a signal which is synchronized with the horizontal synchronization signal LS of the data signals D (display data DR, DG and DB). Moreover, the start pulse SP shifted by the shift register 21 is inputted as the start pulse SP to a shift register 21 of an adjacent source driver, and the start pulse SP thus inputted is shifted in the same way as above. Eventually, the start pulse SP is transferred to a shift register of the farthest source driver from the controller 4.

The input latch circuit 22 temporarily latches the sets of the display data DR, DG and DB each of which is six-bit data and is serially inputted to an input terminal corresponding to each color, and the input latch circuit 22 transfers the sets of the display data DR, DG and DB to the sampling memory 23.

By using the output signals (control signals) from the respective stages of the shift register 21, the sampling memory 23 samples the sets of the display data DR, DG and DB (each of R, G and B has 6 bits, so that the total is 18 bits) transferred from the input latch circuit 22 in a time-divisional manner. Then, the sampling memory 23 stores the sets of the display data DR, DG and DB until all the display data DR, DG and DB for one horizontal synchronization period are supplied.

The holding memory 24 latches the sets of the display data DR, DG and DB according to the hold signal LS. Then, the sets of the display data DR, DG and DB are held until the next horizontal synchronization signal LS is inputted, and are outputted to the level shifter 25.

The level shifter 25 is a circuit which converts a signal level of each of the display data DR, DG and DB by boosting, etc. so that the sets of the display data DR, DG and DB thus converted are compatible with the DA converter which processes levels of voltages applied to the liquid crystal panel 901. The level shifter 25 outputs sets of display data D'R, D'G and D'B.

The reference voltage generating circuit 27 generates 64-level analog voltages, used for displaying gradations, according to a reference voltage VR supplied from the liquid crystal driving power source 905 (see FIG. 1). Then, the 64-level analog voltages thus generated are outputted to the DA converter 26.

Figure 6:
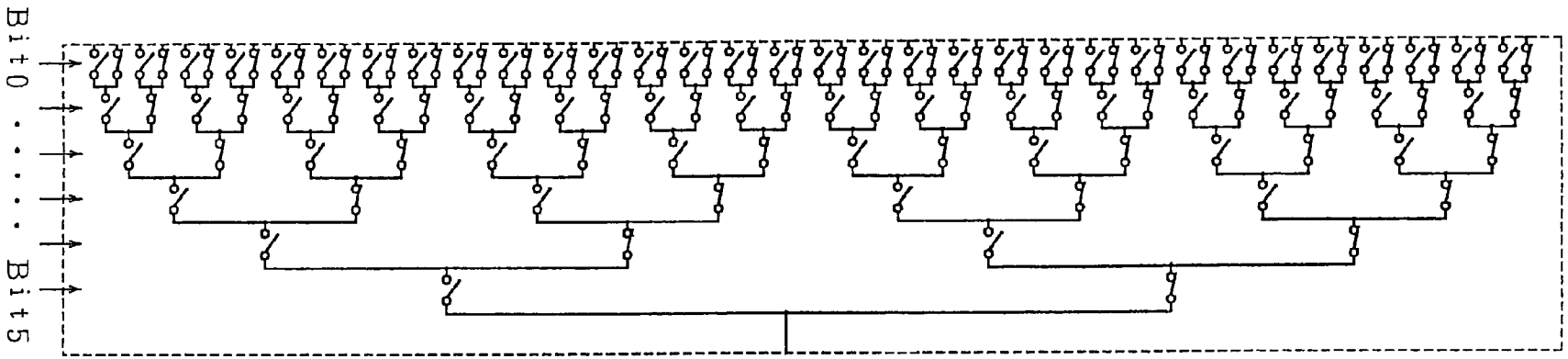
FIG. 6 Conventional Art
FIG. 6 is a circuit diagram illustrating an example of an arrangement of a DA converter.

The DA converter 26 selects one of the 64-level analog voltages according to the sets of the display data (digital) D'R, D'G and D'B (each of R, G and B has 6 bits) inputted from the level shifter 25. In this way, the DA converter 26 performs conversion into the analog voltage and outputs the voltage to the outputting circuit 28. That is, as illustrated in FIG. 6, the DA converter 26 has switches respectively corresponding to 6 bits (Bit 0 to Bit 5).

By selecting the switches respectively corresponding to the sets of the 6-bit display data D'R, D'G and D'B, the DA converter 26 selects one of the 64-level analog voltages inputted from the reference voltage generating circuit 27.

The outputting circuit 28 changes the analog signal selected by the DA converter 26 into a low impedance signal, and outputs the low impedance signal to the switching circuit 30.

According to (i) a clock signal CLK generated by the 1/n frequency divider 31 from the clock signal CK inputted to the shift register 21 and (ii) the hold signal LS which is outputted from the controller 904 and inputted to the holding memory 24 and (iii) 3-bit setting signals CTR1 to CTR3, the pulse width adjusting circuit 29 (for a hold signal LS) adjust a pulse width of the hold signal LSA on a scale of one to n (on a scale of one to eight in the present embodiment). Note that, an arrangement of the pulse width adjusting circuit 29 will be described later in detail.

Figure 9:
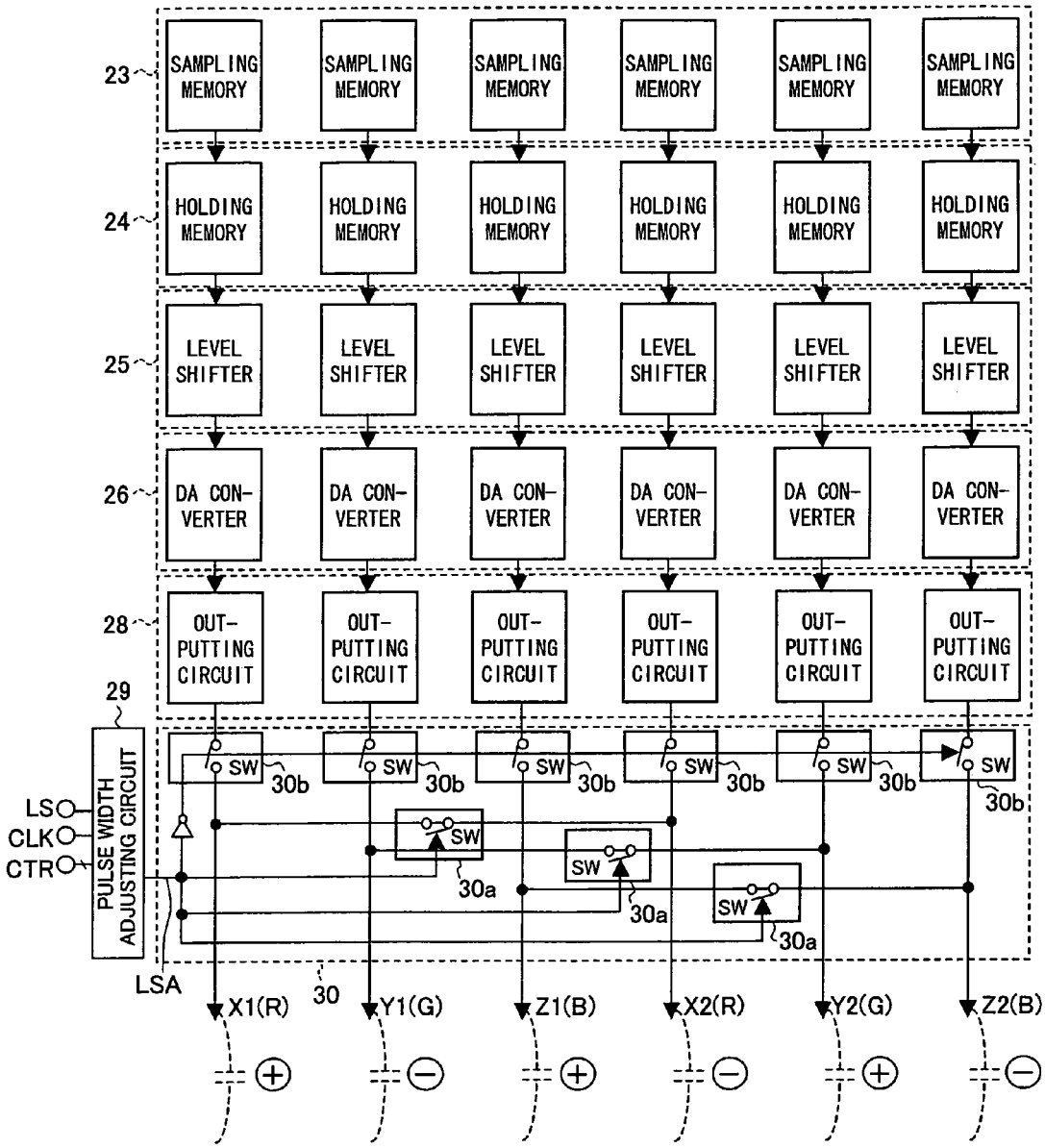
FIG. 9 is a circuit diagram illustrating an example of an arrangement of a switching circuit in accordance with the present invention.

As illustrated in FIG. 9, the switching circuit 30 includes analog switches. That is, the switching circuit 30 includes (i) short-circuiting switches (short-circuiting means) 30*a* by each of which the short-circuiting is carried out between the output terminals connected to pixels of the same color (R, G or B), according to a hold signal LSA outputted from the pulse width adjusting circuit 29 before the switching circuit 30 outputs voltages applied to the liquid crystal and (ii) separating switches (separating means) 30*b* each of which separates the output terminal from the outputting circuit 28 so as to float the output terminal. Further, the switching circuit 30 is so arranged that it is possible to carry out a charge sharing between the output terminals connected to pixels of the same color (R, G or B).

As described above, in the same horizontal period, there are the source signal lines whose source signal potentials are positive and the source signal lines whose source signal potentials are negative (that is, a dot inversion driving is basically performed). Such source signal lines are short-circuited with each other. In this way, it is possible to assist a precharging by electric charges, whose polarities are positive and negative, on data lines of the liquid crystal panel. That is, by utilizing residual electric charge in the liquid crystal panel, it is possible to reduce electric power for driving the liquid crystal. Note that, operations of the switching circuit 30 will be described later in detail.

Figure 7:
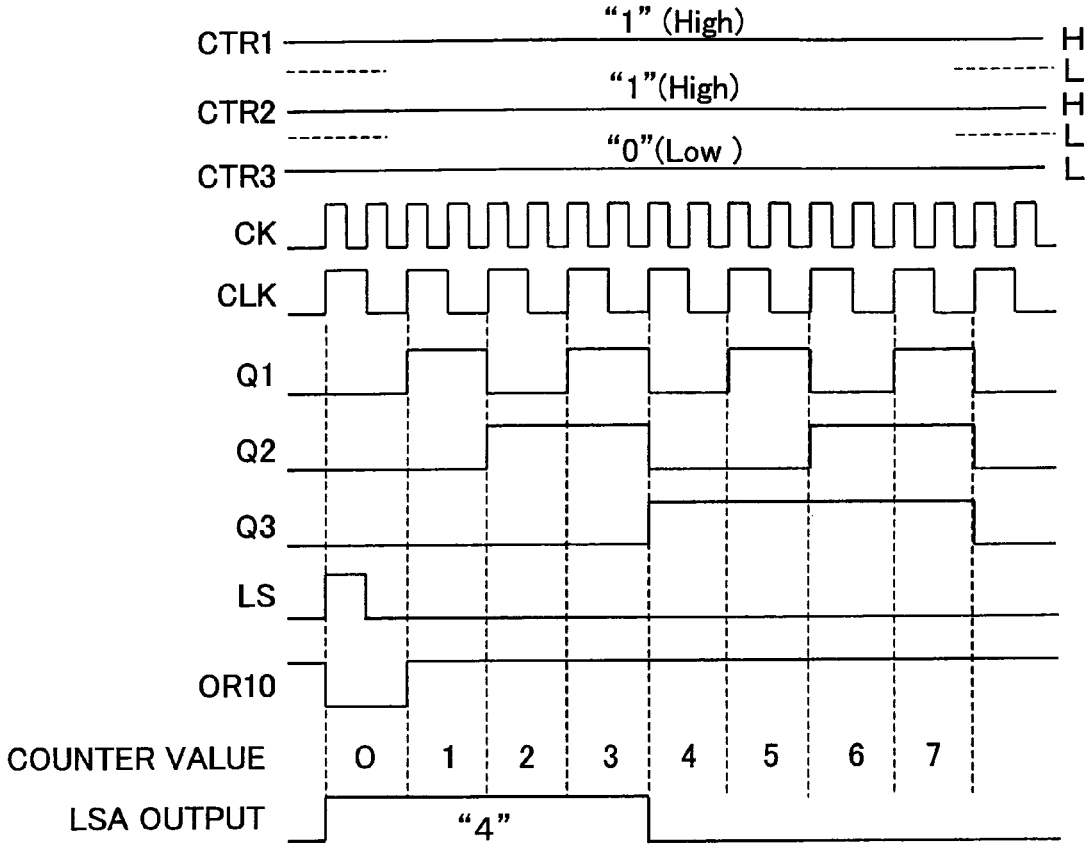
FIG. 7 is a diagram illustrating timings of signals in accordance with the present invention.
Figure 8:
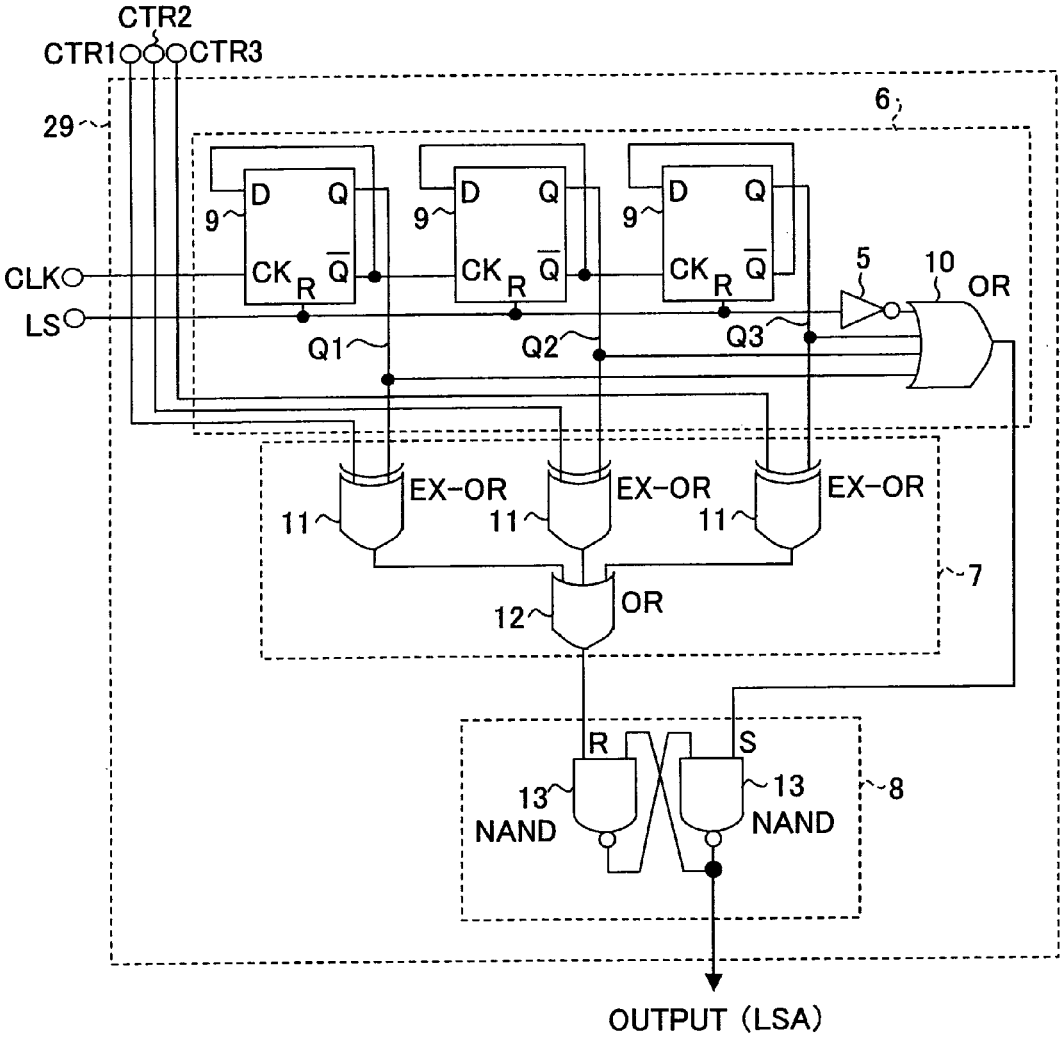
FIG. 8 is a circuit diagram illustrating an example of an arrangement of a pulse width adjusting circuit in accordance with the present invention.

The following explains the details of the pulse width adjusting circuit 29 in reference to FIGS. 7 and 8. Note that, the present invention explains one example in which the setting signals CTR1 to CTR3 have 3 bits ($2^3$=8) and the pulse width can be adjusted on a scale of one to eight. However, the following description is not limited to the adjustment on a scale of one to eight. It is possible to apply other scales according to the setting signals CTR1 to CTR3. For example, when setting signals are 4 bits, the number of setting signals is four (CTR1 to CTR4), and the number of delay T flip flops 9 and the number of EX-OR circuits 11 are also four, respectively.

As illustrated in FIG. 8, the pulse width adjusting circuit 29 includes (i) an up counter circuit 6 as a first signal generating circuit, (ii) a comparator 7 as a pulse width signal adjusting circuit and (iii) an R-S flip flop 8.

The up counter circuit 6 sequentially carries out a counting operation by a clock signal inputted to three delay T flip flops 9 whose number corresponds to the number of setting (3 bits) of the setting signals CTR1 to CTR3.

The comparator 7 includes (i) three Exclusive-OR gates (hereinafter referred to as "EX-OR circuit") 11 whose number is equal to the number of setting (the number of bits) of the setting signals CTR1 to CTR3 and (ii) one OR circuit 12.

The R-S flip flop 8 includes NAND circuits 13.

Each of the delay T flip flops 9 includes (i) a CK terminal which receives the clock signal CLK which is obtained by dividing the clock signal CK, inputted to the shift register 21, by 1/n by the 1/n frequency divider 31, (ii) an R terminal which receives, as a reset signal, a hold signal LS which is the same as the hold signal LS inputted to the holding memory 24 and (iii) output terminals Q and Q bar.

Note that, the output terminal Q bar outputs an inversion signal of a signal outputted from the output terminal Q.

Signals Q1, Q2 and Q3 (see FIG. 7) outputted, as a group of first signals, from the respective output terminals Q of three delay T flip flops 9 are supplied to an OR circuit 10. The group of first signals is also outputted to the comparator 7. Meanwhile, a signal outputted from each output terminal Q bar is inputted to a D terminal of the delay T flip flop 9. Moreover, the signal outputted from the output terminal Q bar of the delay T flip flop 9 in the first (second) stage is inputted as the clock signal to the CK terminal of the delay T flip flop 9 in the next (second or third) stage.

To the OR circuit 10, the signals Q1, Q2 and Q3 from the delay T flip flops 9 and a signal obtained by inverting, by an inverter 5, the hold signal LS inputted to the holding memory 24 are inputted.

That is, in the up counter circuit 6 arranged as above, i) the clock signal CLK which is obtained by dividing by 1/n the clock signal CK inputted to the shift register 21 and (ii) the hold signal LS inputted to the holding memory 24 are inputted to three delay T flip flops 9, and the delay T flip flops 9 outputs the signals Q1, Q2 and Q3, whose waveforms are illustrated in FIG. 7, to the OR circuit 10. Here, the number of delay T flip flops 9 corresponds to the number of setting (3 bits) of the setting signals CTR1 to CTR3. In this way, the up counter circuit 6 counts the number of pulses of the clock signal CLK from 0 to 7.

The following briefly explains the signal outputted from the terminal Q of the delay T flip flop 9 in reference to FIG. 7. Note that, each signal is a binary signal, that is, the level of each signal is two ("1" or "0").

The signal Q1 outputted from the terminal Q of the delay T flip flop 9 in the first stage is a pulsed signal whose "0" and "1" are inverted in each cycle of the pulse of the clock signal CLK. That is, the signal Q1 is "0" in the first cycle of the pulse in one horizontal period and "1" in the next cycle.

Moreover, the signal Q2 outputted from the terminal Q of the delay T flip flop 9 in the second stage is a pulsed signal whose "0" and "1" are inverted per two cycles of the pulse of the clock signal CLK. Similarly, the signal Q2 is "0" in the first cycle of the pulse in one horizontal period.

Further, the signal Q3 outputted from the terminal Q of the delay T flip flop 9 in the third stage is a pulsed signal whose "0" and "1" are inverted per four cycles of the pulse of the clock signal CLK. Similarly, the signal Q3 is "0" in the first cycle of the pulse in one horizontal period.

Moreover, a signal OR10 which is a count signal from the up counter circuit 6 is "0" in the beginning of the horizontal period, that is, in the first cycle of the pulse of the clock signal CLK. However, the signal OR10 is "1" from the second cycle of the pulse of the clock signal CLK.

To the EX-OR circuits 11, the signals Q1, Q2 and Q3 from the delay T flip flops 9 of the up counter 6 are inputted, respectively. Moreover, the setting signals CTR1 to CTR3 are also inputted to the EX-OR circuits 11, respectively.

Moreover, when two signals thus inputted to each of the EX-OR circuits 11 are the same, "0" (a low-level signal) is supplied from the Ex-OR circuit 11 to the OR circuit 12. Meanwhile, when the two signals are different, "1" (a high-level signal) is supplied from the EX-OR circuit 11 to the OR circuit 12.

The signal is inputted from the EX-OR circuits 11 to the OR circuit 12. Then, the OR circuit 12 outputs the reset signal, which is a second signal inputted to the R-S flip flop circuit 8 in the next stage.

That is, the comparator 7 compares set values of the setting signals CTR1 to CTR3 with data values from the up counter circuit 6. Then, according to the set values, the comparator 7 resets the R-S flip flop circuit 8.

As described above, to the R-S flip flop circuit 8, the signal OR10 from the up counter circuit 6 is inputted as the set signal, and the signal from the comparator 7 is inputted as the reset signal. Then, the R-S flip flop circuit 8 adjusts the pulse width of the hold signal LSA according to the set values of the setting signals CTR1 to CTR3, and outputs the hold signal LSA.

That is, the hold signal LSA is obtained by adjusting the number of pulses (here, eight pulses (0 to 7)) of the clock signal CLK according to the setting signals CTR1 to CTR3, and is outputted.

According to one example of the hold signal LSA shown in FIG. 7, when CTR1="1", CTR2="1" and CTR3="0", the hold signal LSA has a pulse width corresponding to four pulses of the clock signal CLK.

That is, when the number of pulses adjusted is x and the values of CTR1, CTR2 and CTR3 are a, b and c, respectively, $$\begin{aligned} x &= c\cdot 2^2 + b\cdot 2^1 + a\cdot 2^0 + 1 \\ &= 0 + 2 + 1 + 1 \\ &= 4 \end{aligned}$$

Figure 10:
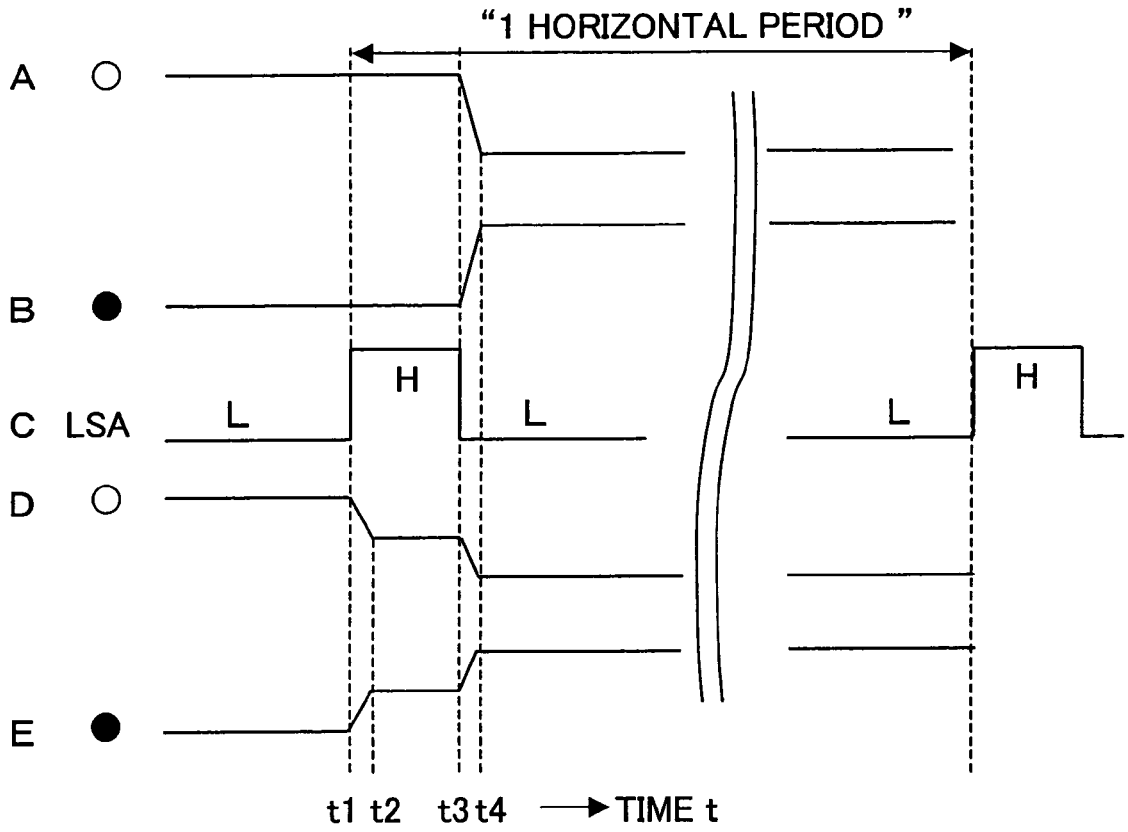
FIG. 10 is a diagram illustrating timings of the switching circuit in accordance with the present invention.

FIG. 10 is a timing chart for explaining timings of the switching circuit 30 illustrated in FIG. 9. In FIG. 10, a high period of the hold signal LSA corresponds to a period from t1 to t3.

In FIG. 10, A and B are conventional source signal potentials in the case in which the charge sharing is not carried out. D and E are source signal potentials of the present invention.

Figure 24:
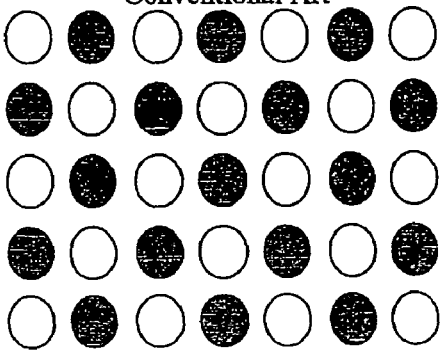
FIG. 24 (a) Conventional Art
FIGS. 24(*a*) and 24(*b*) are diagrams illustrating examples of various inversion driving methods.
Figure 24:
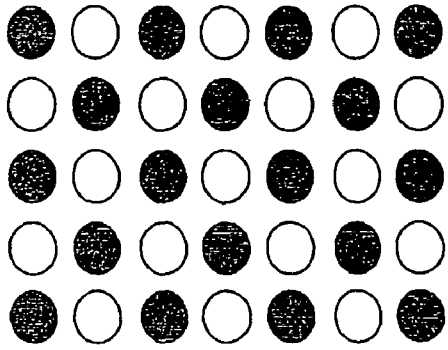
FIG. 24 (b) Conventional Art

In the dot inversion driving illustrated in FIG. 24, D and E are the source signal potentials of arbitrary source signal lines whose directions of electric fields applied to the liquid crystal are opposite to each other. In the case of a black and white display, the arbitrary source signal lines are, for example, source signal lines adjacent to each other. In the case of a color display, the arbitrary source signal lines are, for example, source signal lines for a single color (red and red, blue and blue, etc.) and are adjacent to each other.

The above description is much the same for A and B.

Time t1 is a start time of one horizontal period. As with conventional circuit arrangements, until Time t1, the hold signal LSA is a low level, the separating switches 30*b* are closed (ON), and the short-circuiting switches 30*a* are opened (OFF). Moreover, output signals D and E outputted from the outputting circuit 28 via the separating switches 30*b* and the output terminals are the same as conventional output signals A and B.

Then, Time t1, which is the start time of the horizontal period, and a rise of the hold signal LSA are synchronized with each other. As a result, at Time t1, the hold signal LSA becomes a high level "H", the separating switches 30*b* are turned OFF and the short-circuiting switches are turned ON. Because the separating switches 30*b* are turned OFF, the outputting circuit 28 and the output terminal are electrically separated. Moreover, because the short-circuiting switches 30*a* are turned ON, the output terminals connected to pixels of the same color (R, G or B) are electrically connected. Therefore, the electric charge moves between those output terminals. Then, at a certain time (at Time t2), potentials of the output signals D and E become the same. A time from Time t1 to Time t2 is a charging/discharging time which is determined according to the load capacitance.

From t1 to t2, the electric charge moves between the output terminals. Therefore, no electric power is consumed.

Next, at Time t3, the hold signal LSA becomes a low level "L", the separating switches 30*b* are turned ON and the short-circuiting switches are turned OFF. Therefore, the state of the circuit here becomes the same as that of the circuit until Time t1. On this account, the outputting circuit 28 charges/discharges the electric charge of the load capacitance of the source signal lines, and the electric power is consumed. At a certain time (at Time t4), the potentials of the output signals D and E are desired values (source signal potentials). A time from Time t3 to Time t4 is a charging/discharging time which is determined according to the load capacitance.

As above, the process is carried out as follows:

(a) at the start time of one horizontal period, the source signal lines and the source driver are separated;

(b) at the time of (a), the source signal lines are short-circuited with each other;

(c) after (b), the short-circuiting between the source signal lines is stopped; and (d) at the time of (c), the source signal lines and the source driver are reconnected.

Note that, (b) may be carried out after (a), and (d) may be carried out after (c).

Moreover, (c) may be carried out at the time of (b) (that is, the time for the short-circuiting is none). Further, even in the case in which a time period when the hold signal LSA is high is decreased and the short-circuiting is canceled before the potentials of the short-circuited source signal lines become the same (that is, even in the case in which, before reaching the potential (short-circuit potential) of t2 of FIG. 10, the process proceeds from t3 to t4), it is possible to obtain an effect of the precharging, to some degree.

A time period of the short-circuiting (short-circuit time) is determined in consideration of the following factors.

Factor 1: How close should the potentials of the source signal lines be shifted to a medium potential (short-circuit potential)?

Factor 2: To what extent should the source signal lines be charged so as to apply a desired voltage (display voltage) to the liquid crystal?

Factor 3: How much time is required for the voltages to rise and fall? (the time required for the voltages to rise and fall is determined by the load capacitance, and is therefore unchangeable)

When importance is attached to Factor 1, the pulse width adjusting circuit 29 prolongs the high-period of the hold signal LSA and thereby prolongs the duration of short-circuiting. When importance is attached to Factor 2, the pulse width adjusting circuit 29 shortens the high-period of the hold signal LSA and thereby shortens the duration of short-circuiting. Thus, the values of CTR1 to CTR3 are determined so that the high-period of the hold signal LSA has a desired length. Note that, if it is necessary to carry out the adjustment more precisely, the pulse width adjusting circuit 29 may use four CTRs. In this case, the values of CTR1 to CTR4 are determined on a scale of one to sixteen. If it is necessary to carry out the adjustment much more precisely, the pulse width adjusting circuit 29 may use five CTRs, and so forth.

In this way, without adjusting the timing of the pulse width (high period) of a SELECT signal by the controller, a driving voltage is easily changed to a medium driving voltage by the charge sharing. After that, it is possible to change smoothly to the voltage applied to liquid crystal panel (display voltage).

Figure 25:
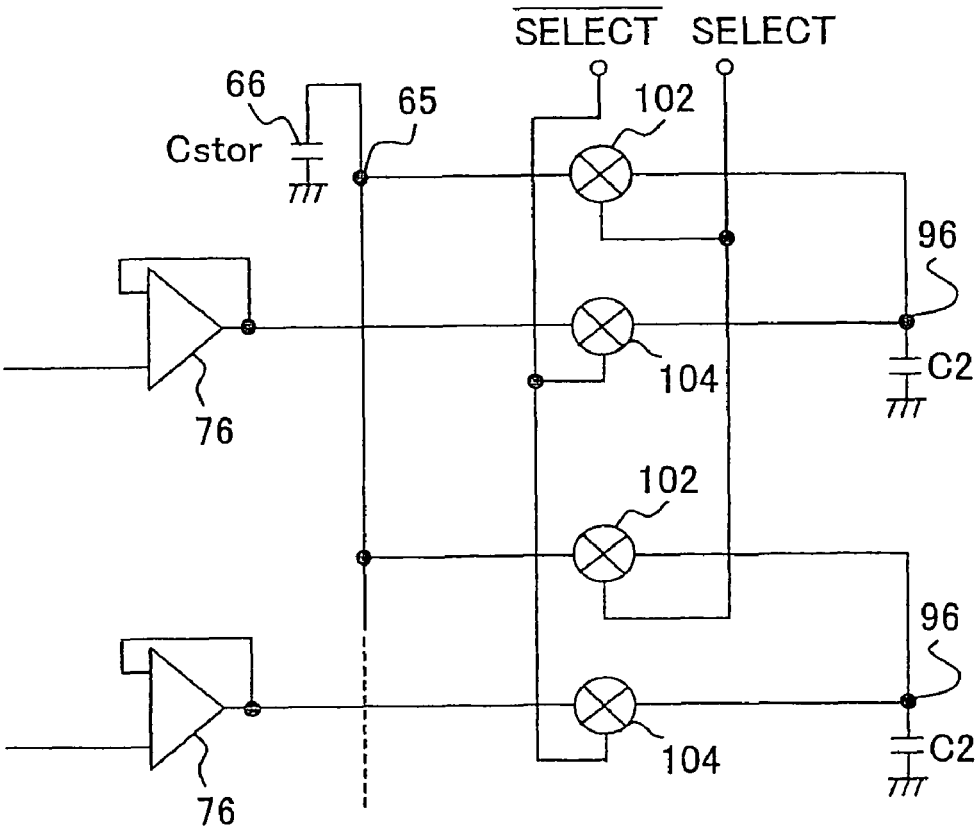
FIG. 25 Conventional Art
FIG. 25 is a circuit diagram illustrating an example of an arrangement of a conventional dot inversion driving device.

As illustrated in FIG. 25, in the case of a conventional arrangement in which an external memory capacitor is used, a combination of old peripheral devices and a new liquid crystal panel requires an adjustment of the external memory capacitor in order to carry out the charge sharing correctly. Meanwhile, in the present embodiment, without depending on the external memory capacitor, the charge sharing is completed by short-circuiting the source signal lines with each other inside the new liquid crystal panel. Therefore, the external memory capacitor is unnecessary, and the adjustment of the external memory capacitor is obviously unnecessary.

As described above, the adjusting circuit, which is capable of changing the pulse width of the hold signal easily, is provided within the source driver. Therefore, the control signal for charge sharing can be changed easily without requiring to change the controller LSI, even though the load capacitance and the like are subject to change depending on the material of the liquid crystal panel and the number of pixels provided on the liquid crystal panel. Therefore, it is possible to realize the improvement of reliability and the high efficiency of designing.

Figure 11:
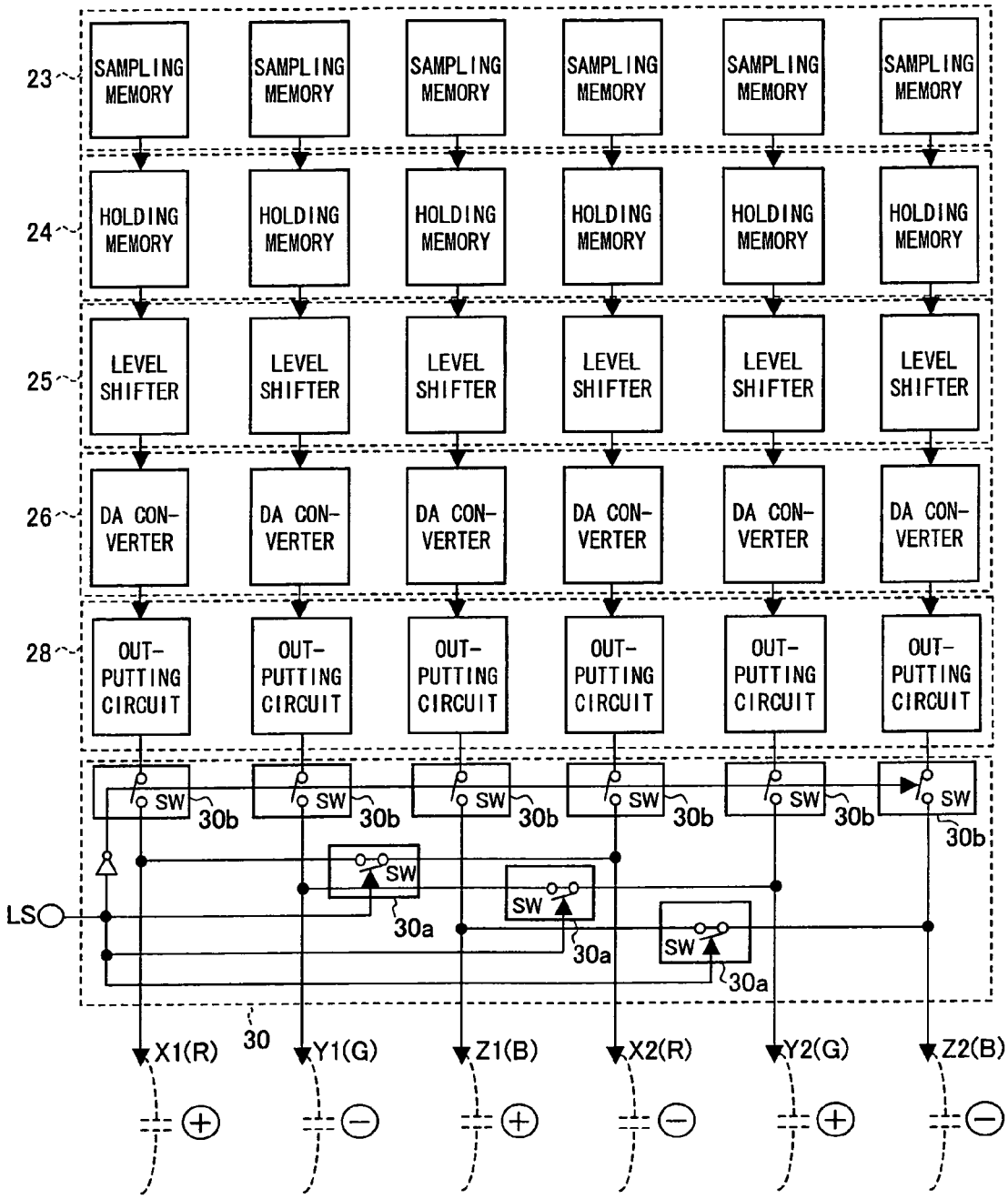
FIG. 11 is a circuit diagram illustrating an example of an arrangement of another switching circuit in accordance with the present invention.

Note that, explained above is one example in which the adjustment is carried out by the output signal from the pulse width adjusting circuit provided in the source driver. Needless to say, it is possible to easily change the arrangement by containing a similar circuit means in the controller. In this case, as illustrated in FIG. 11, the switching circuit in the source driver includes (i) short-circuiting switches (short-circuiting means) 30*a* by each of which the short-circuiting is carried out between the output terminals connected to pixels of the same color (R, G or B) and (ii) separating switches (separating means) 30*b* each of which separates the output terminal from the outputting circuit 28 so that the output terminal is in the state of floating. In this way, it is possible to carry out the charge sharing between the output terminals connected to pixels of the same color (R, G or B).

In this case, the controller includes (i) a basic control section whose functions are the same as those of the controller of FIG. 9 and (ii) a pulse width adjusting section (not illustrated) corresponding to the pulse width adjusting circuit 29. Moreover, in this case, the controller is so arranged as to output to the source driver a signal, as the hold signal LS, whose pulse width can be adjusted by the pulse width adjusting section just like the above-described hold signal LSA.

Output terminals X1 to X128, Y1 to Y128 and Z1 to Z128 correspond to the display data DR, DG and DB, respectively. The number of each of the output terminals X, Y and Z is 128. Thus, according to the sets of the display data DR, DG and DB, source drivers for displaying 64 gradations output, to a liquid crystal panel, analog signals corresponding to gradation levels. As a result, 64-gradation displaying is carried out.

Moreover, the short-circuiting is carried out between the source signal lines connected to pixels of the same color (R, G or B). However, as long as polarities are different between the electric charges of the source signal lines, the short-circuiting can be carried out between the source signal lines connected to pixels (R, G or B) whose colors are different from each other (such as R and G, G and B, etc.).

Moreover, the present invention is applicable not only to the case of color display, but also to the case of monochrome display or binary image display.

Moreover, in FIG. 9, when focusing on the pixels R, the short-circuiting is carried out between one (+) output terminal (X1) and one (−) output terminal (X2). However, for example, it is possible to carry out the short-circuiting between two (+) output terminals and two (−) output terminals. Moreover, even when the number of (+) output terminals and the number of (−) output terminals are different (for example, two (+) output terminals and one (−) output terminal), it is possible to carry out the short-circuiting.

A liquid crystal driving circuit of the present invention is a liquid crystal driving circuit which drives a liquid crystal display device according to display data signals, and includes (i) a transferring circuit (shift register) which transfers a start pulse signal based on a clock signal, (ii) a latch circuit (input latch circuit) which fetches a display data signal in synchronism with the clock signal and outputs the display data signal as a set of synchronous data, (iii) a sampling circuit (sampling memory) which samples and outputs the set of the synchronous data according to the start pulse signal, (iv) a DA converter which carries out the DA conversion (Digital-Analog conversion) according to the data from the sampling circuit and (v) an outputting circuit which outputs, from a liquid crystal driving voltage output terminal, a voltage which is applied to the liquid crystal and is obtained from a gradation displaying analog voltage (for displaying gradations) obtained by the DA converter, and the liquid crystal driving circuit further includes a switching circuit which includes (i) a short-circuiting switching circuit which short-circuits the output terminals with each other, which are connected to pixels of the same color (R, G or B), before the outputting circuit outputs the voltage applied to the liquid crystal and (ii) a separating switch means which separates the output terminal from an outputting means so that the output terminal is in the state of floating.

Moreover, in addition to the above arrangement, the switching circuit of the liquid crystal driving circuit of the present invention may be arranged so that the charge sharing is carried out according to a control signal (LSA) temporarily stored in the source driver.

Moreover, in addition to the above arrangement, the switching circuit of the liquid crystal driving circuit of the present invention may be arranged so that a pulse width is adjusted according to binary setting signals (CTR1, CTR2 and CTR3) inputted from setting terminals.

Moreover, in addition to the above arrangement, the switching circuit of the liquid crystal driving circuit of the present invention may be arranged so that the charge sharing is carried out according to a control signal (LS) from the controller and can adjust a pulse width according to binary setting signals (CTR1, CTR2 and CTR3) inputted from setting terminals.

Moreover, according to the present invention, it is possible to realize a liquid crystal display device containing the liquid crystal driving circuit arranged as above.

Embodiment 2

The following explains another embodiment of the present invention in reference to FIGS. 12 to 17. Note that, for ease of explanation, the same symbols are used for the members that have the same functions as the members used in the figures of Embodiment 1, and further explanations thereof are omitted here.

Depending on user requests, a new device may be produced by increasing or decreasing the number of output terminals of the existing source driver 902 illustrated in FIG. 1.

Figure 12:
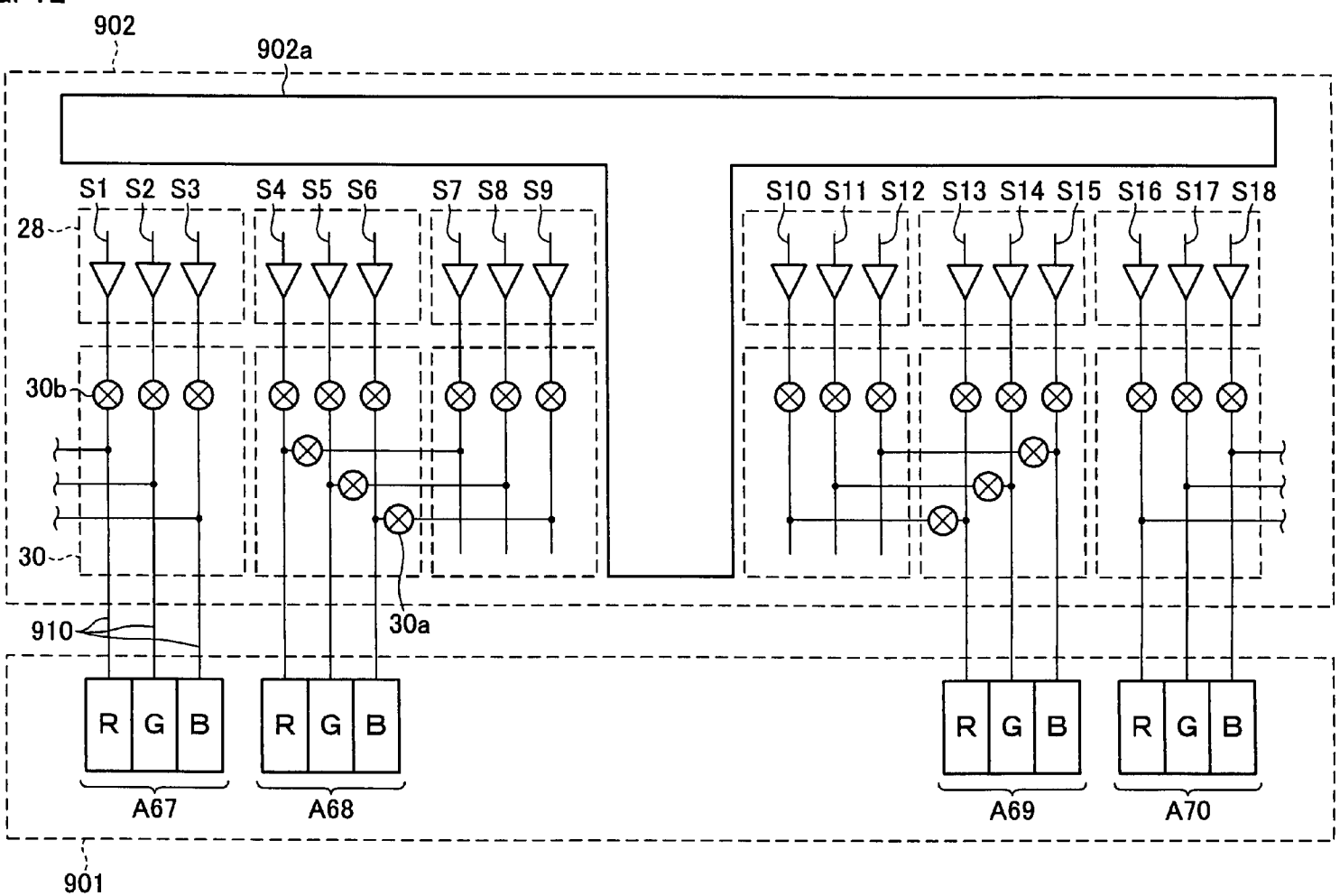
FIG. 12 is a block diagram illustrating an example of an arrangement of the source driver.

FIG. 12 is a diagram illustrating an arrangement of the source driver 902 arranged as above. In FIG. 12, the number of output terminals is 420. However, the source driver 902 is so arranged that two sets of three output terminals 910 (total of six) sandwiching a logic circuit 902*a* are not used. Therefore, the number of output terminals is 414 (=420−6). A plurality of such source drivers 902 are provided in the liquid crystal panel 901.

Therefore, those six output terminals 910 are not connected to pixels R, G and B. FIG. 12 illustrates source signal lines S1 to S18. The output terminals 910 of the source signal lines S1 to S6 and the output terminals 910 of the source signal lines S13 to S18 are connected to the pixels, respectively. However, the output terminals of the source signal lines S7 to S12 are not connected to the pixels.

Therefore, the charge sharing is not carried out through the short-circuiting switches (short-circuiting means) 30*a* connected to two sets of three output terminals sandwiching the logic circuit 902 provided at the center of the source driver. In the description here, six output terminals connected to pixel groups A68 and A69 each composed of the pixels R, G and B are relevant to those two sets of three output terminals, and the charge sharing is not carried out for those six output terminals. Meanwhile, as for the output terminals connected to the pixel groups A67 and A70, the charge sharing is carried out between the output terminals which are adjacent with each other and are of the same color. Therefore, it is possible to reduce electric power consumption.

Figure 13:
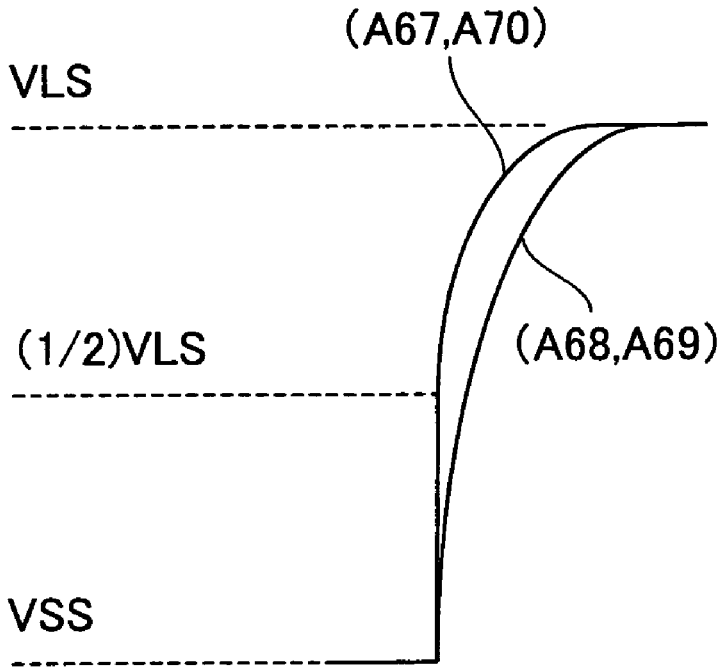
FIG. 13 is a diagram illustrating one example of waveforms of transient voltages outputted from output terminals of the source driver illustrated in FIG. 12.

Here, FIG. 13 illustrates one example of waveforms of transient voltages outputted from the output terminals 910 of the source driver 902 illustrated in FIG. 12. One of the waveforms is a waveform of the transient voltage outputted from each of the output terminals, between which the charge sharing is carried out, connected to the pixel group A67 composed of the pixels R, G and B or the pixel group A70 composed of the pixels R, G and B. Another one of the waveforms is a waveform of the transient voltage outputted from each of the output terminals, between which the charge sharing is not carried out, connected to the pixel group A68 composed of the pixels R, G and B or the pixel group A69 composed of the pixels R, G and B.

Figure 14:
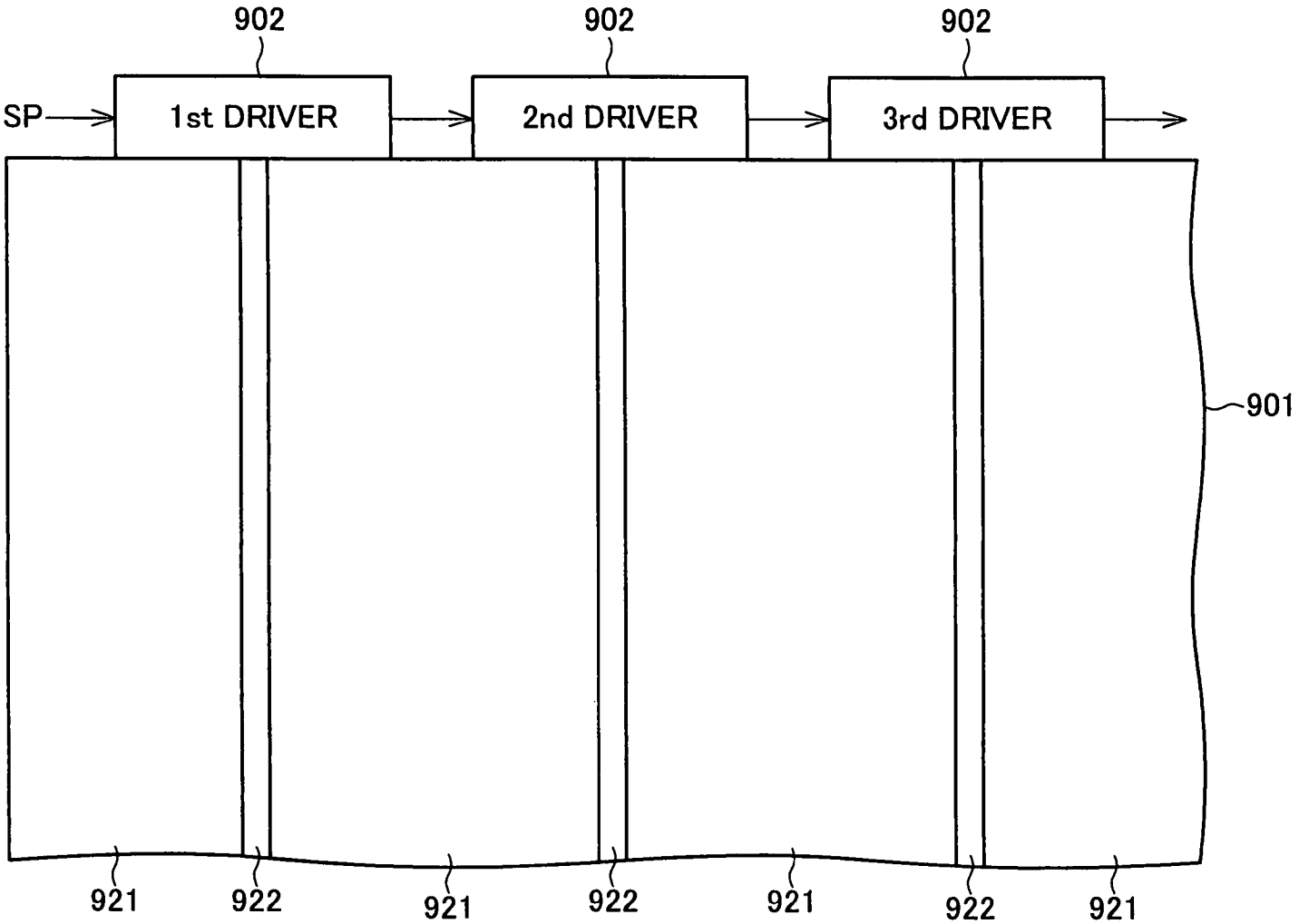
FIG. 14 is a diagram illustrating one example of a case in which a plurality of the source drivers illustrated in FIG. 12 are provided on a liquid crystal panel.

When comparing those waveforms, the waveform of the transient voltage outputted from each of the output terminals, between which the charge sharing is carried out, connected to the pixel group A67 composed of the pixels R, G and B or the pixel group A70 composed of the pixels R, G and B reaches (½) VLS faster than the waveform of the transient voltage outputted from each of the output terminals, between which the charge sharing is not carried out, connected to the pixel group A68 composed of the pixels R, G and B or the pixel group A69 composed of the pixels R, G and B. Note that, VLS is a maximum value of an output amplitude level, and VSS is a minimum value of the output amplitude level. As a result, depending on whether or not the charge sharing is carried out, the difference is given between the waveforms of the transient voltages outputted from the output terminals of the driver. Therefore, as illustrated in FIG. 14, in the case in which a plurality of source drivers 902 are provided on the liquid crystal panel 901, display troubles (vertical lines) may occur due to the difference between the waveforms of the transient voltages. FIG. 14 illustrates one example of the display troubles. When the liquid crystal panel 901 carries out an entirely gray display, pale vertical lines 922 may be generated at the center of the chip of the source driver 902 because of the six output terminals. Reference numeral 921 is a normal display portion where no vertical lines are generated.

Here, the present embodiment is so arranged that the charge sharing is carried out between the output terminals connected to pixels of the same color (R, G or B), without being influenced by the change in the number of output terminals according to user requests. In this way, the difference between the waveforms of the transient voltages is eliminated, and the reduction of the electric power consumption is realized.

Figure 15:
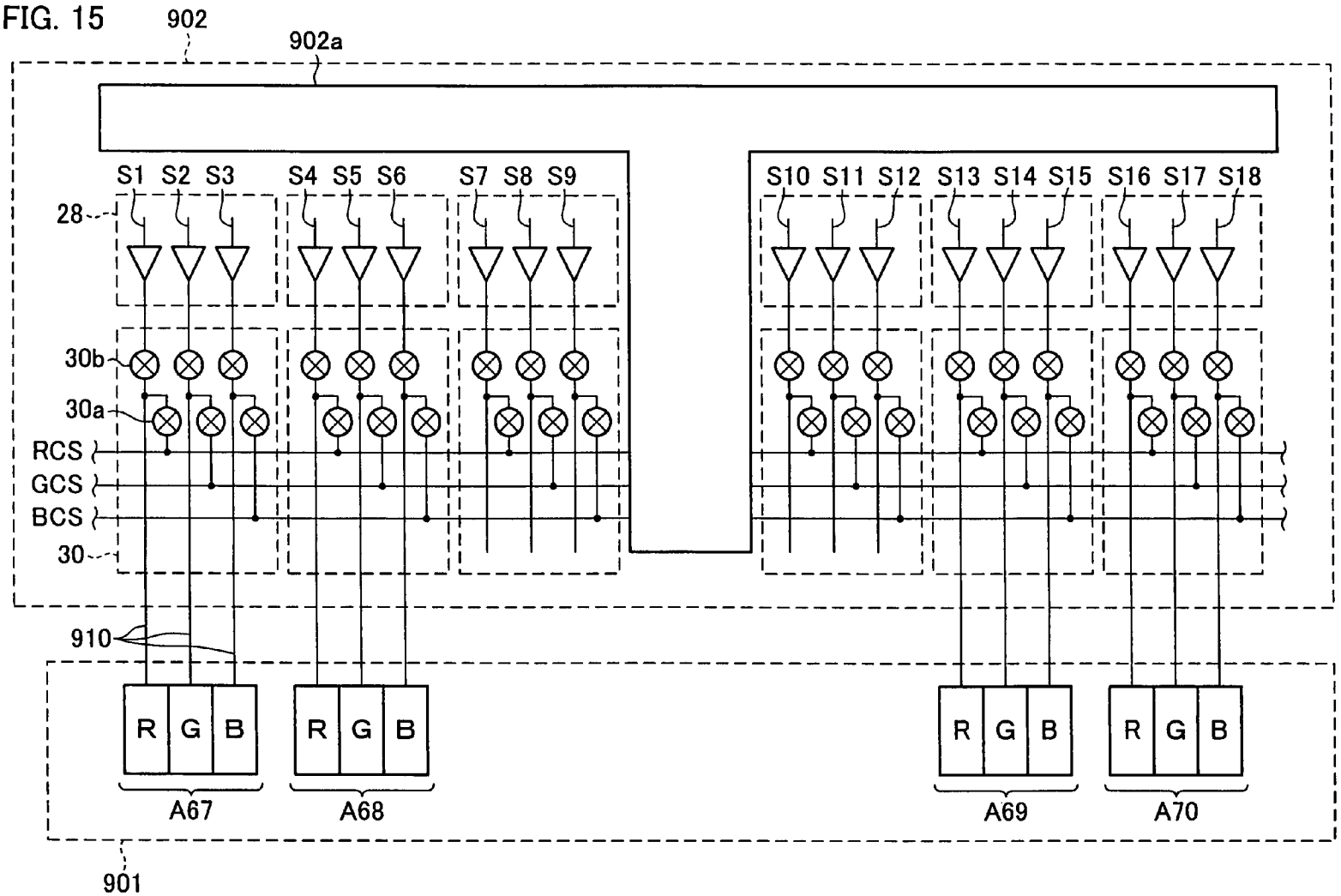
FIG. 15 is a circuit diagram illustrating an example of an arrangement of yet another switching circuit in accordance with the present invention.

As illustrated in FIG. 15, the outputting circuit 28 in the source driver is connected to the switching circuit (switching circuit section) 30 which includes (i) short-circuiting switches (short-circuiting means) 30*a* by each of which the short-circuiting is carried out between the output terminals 910 connected to pixels of the same color (R, G or B) and (ii) separating switches (separating means) 30*b* each of which separates the output terminal 910 from the outputting circuit 28 so that the output terminal 910 is in the state of floating.

Especially, in order to carry out the charge sharing between the output terminals 910 connected to pixels of the same color (R, G or B), one end of the short-circuiting switch (short-circuiting means) 30*a* is connected to one of common bus lines RCS, GCS and BCS. As a result, without being influenced by the change in the number of output terminals, the charge sharing can be carried out between the output terminals 910 connected to pixels of the same color (R, G or B), via one of the common bus lines RCS, GCS and BCS.

Thus, in the present embodiment, each image is displayed by the pixel group composed of one or more pixels. Here, "each image" does not mean an image displayed by the entire screen but means an image displayed by pixel(s) by which users can recognize one color, that is, an image displayed by the pixels R, G and B (here, these three pixels are collectively referred to as "pixel group"). In the case of a monochrome display, one pixel group may be composed of only one pixel.

Moreover, via the short-circuiting switches 30*a* provided between the pixels, each pixel in each pixel group is connected to at least one pixels in all the other pixel groups. Then, in the precharging, the short-circuiting switches simultaneously turn ON/OFF.

With the above arrangement, each of the pixels in the pixel groups is connected to at least one pixel in the other pixel group so that the short-circuiting can be carried out. For example, when focusing on a pixel R in a certain pixel group, the pixel R is connected to at least one of pixels R, G and B in all of the pixel groups except in the pixel group including the pixel R in the certain pixel group. In FIG. 15, a pixel R in a certain pixel group is connected to the pixels R in all the pixel groups except the pixel group including the pixel R. This is much the same for the pixels G and B.

In addition to the arrangement illustrated in FIG. 15, for example, by suitably increasing/decreasing the number of the short-circuiting switches 30*a*, it is possible to connect a pixel R in a first pixel group, a pixel G in a second pixel group, pixels R, G and B in a third pixel group, pixels G and B in a fourth pixel group, a pixel R in a fifth pixel group, etc. with each other. For example, in the arrangement of FIG. 15, the positions of the short-circuiting switches 30*a* are changed so that the bus line connected to the pixel R of the pixel group A67 and the bus line connected to the pixel G of the pixel group A67 are switched. In this way, the pixel R of the pixel group A67 is connected to the pixels G of all the pixel groups except to the pixel G of the pixel group A67.

Thus, even when a certain pixel group is separated from the source signal lines, the other pixel groups do not lose their partner for the short-circuiting. Therefore, the short-circuiting is carried out without fail. As a result, even when the pixel groups are decreased from the existing source driver, it is possible to suppress generating display troubles, such as vertical lines, etc.

Especially, in the present arrangement, the switching circuit 30 includes the short-circuiting switches 30*a* and the separating switches 30*b*. Each short-circuiting switch 30*a* carries out the short-circuiting between the source signals lines 1004 (S1, S2, . . . ) connected to pixels of the same color (R, G or B). One end of the short-circuiting switch 30*a* is connected to the source signal line, and another end of the short-circuiting switch 30*a* is connected to one of the bus lines RCS, GCS and BCS which are respectively common to the pixels R, G and B. Each separating switch 30*b* separates the outputting circuit from a source signal line, so that the outputting circuit is in the state of floating. Then, in the precharging, the short-circuiting is carried out between the source signal lines connected to pixels of the same color (R, G or B). In this way, the precharging of the source signal lines is carried out. That is, in the present embodiment, through bus lines and the short-circuiting switches between the pixels and the bus line, each pixel in each pixel group is connected to at least one pixel in all the other pixel groups. In the present embodiment, furthermore, only the pixels of the same color are connected with each other via the short-circuiting switches.

Note that, in addition to an arrangement in which the bus lines are provided respectively for the pixels R, G and, B, an arrangement in which the pixels of different colors exist in one group, such as Group 1: X1 (R) (+), X2 (G) (−), X3 (R) (+), X4 (B) (−)
Group 2: Y1 (G) (+), Y2 (R) (−), Y3 (B) (+), Y4 (R) (−)
Group 3: Z1 (B) (+), Z2 (B) (−), Z3 (G) (+), Z4 (G) (−), can obtain an effect of the charge sharing. Note that, as described above, it is not necessary to correspond the number of (+) output terminals with the number of (−) output terminals. Moreover, the total amount of electric charge of (+) output terminals of the short-circuiting may be different from the total amount of electric charge of (−) output terminals of the short-circuiting.

Moreover, (in the monochrome display or a color display,) it is possible to obtain the effect of the charge sharing by (i) an arrangement in which all the pixels are connected by one bus line, or (ii) an arrangement in which all the pixels R and G are connected by one bus line and all the pixels B are connected by another bus line.

Figure 16:
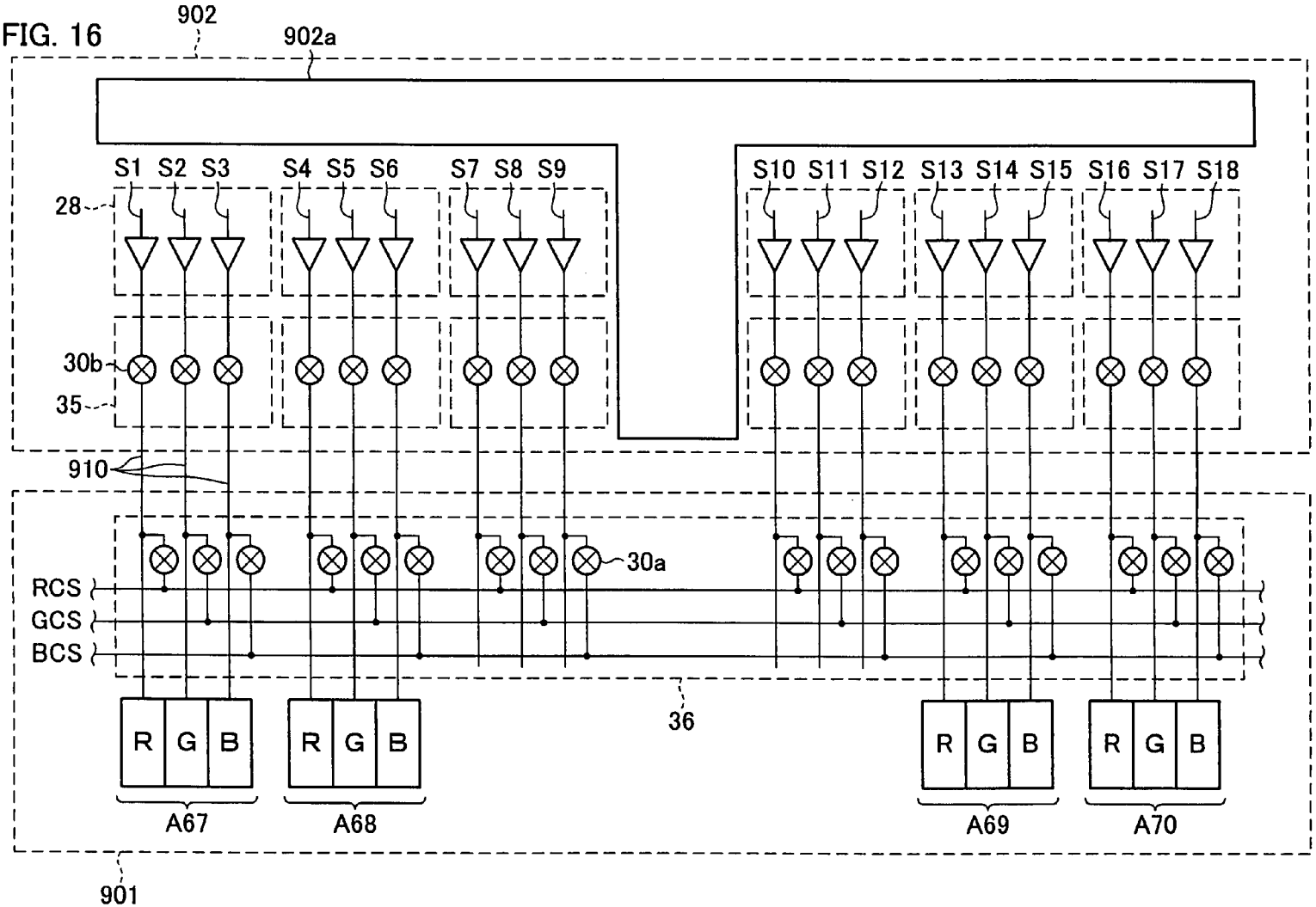
FIG. 16 is a circuit diagram illustrating an example of an arrangement of yet another switching circuit in accordance with the present invention.

Next, FIG. 16 is a modified example of the present embodiment. In the arrangement of FIG. 16, a portion of the switching circuit (switching circuit section) 30 provided in the source driver 902 illustrated in FIG. 15, that is, the short-circuiting switches (short-circuiting means) 30*a* for carrying out the short-circuiting between output terminals connected to pixels of the same color (R, G or B) are provided on the liquid crystal panel 901. In this way, the system is simplified. That is, reference numeral 35 in the source driver 902 is the first half portion of the switching circuit 30, and reference numeral 36 in the liquid crystal panel 901 is the second half portion of the switching circuit 30.

Thus, it is possible to simplify the system by providing the short-circuiting switches 30*a* on the liquid crystal panel which is a display section of a display device.

Note that, in the arrangement of FIG. 16, the short-circuiting switches 30*a* of the switching circuit (switching circuit section) 30 are provided on the liquid crystal panel 901. Needless to say, the separating switches (separating means) 30*b* which cause the output terminals to be in the state of floating can also be provided on the liquid crystal panel 901.

Thus, the present embodiment is so arranged that the charge sharing is carried out between the source signal lines connected to pixels of the same color (R, G or B), without being influenced by the change in the number of output terminals. In this way, the difference between the waveforms of the transient voltages is eliminated. As a result, it is possible to further improve the reliability and realize the reduction of the electric power consumption.

Figure 17:
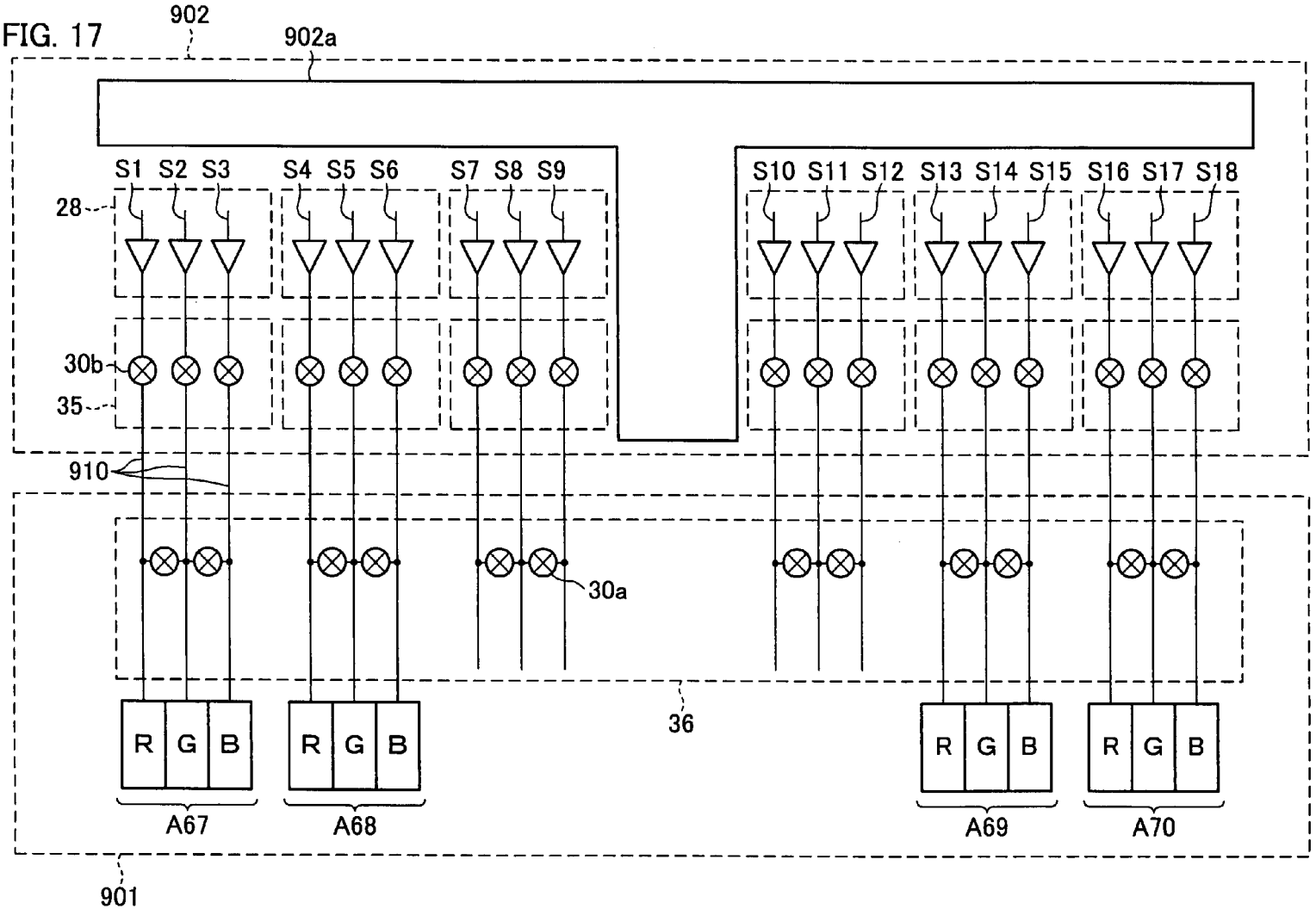
FIG. 17 is a circuit diagram illustrating an example of an arrangement of yet another switching circuit in accordance with the present invention.
Figure 18:
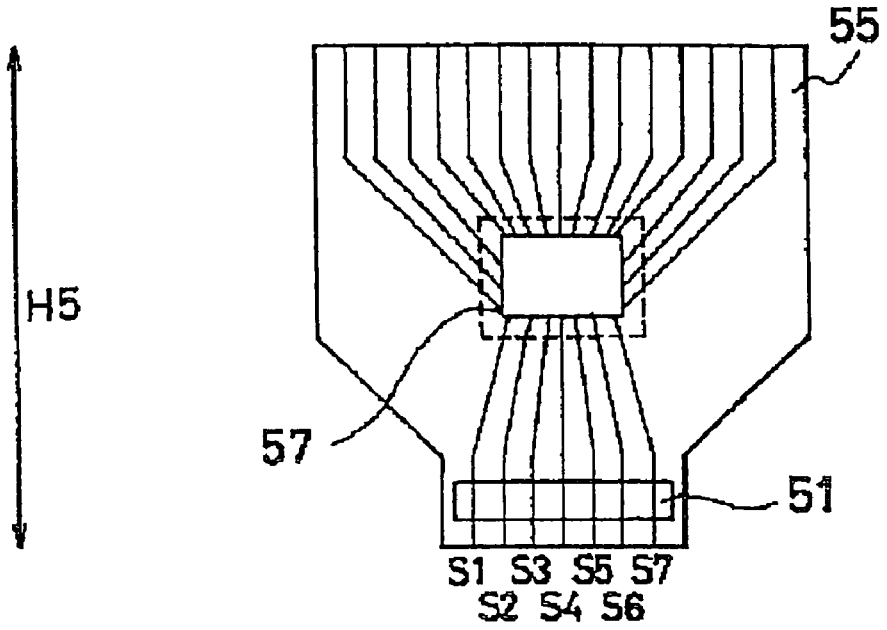
FIG. 18 Conventional Art
FIG. 18 is a plan view illustrating an arrangement of a TCP of a conventional driver IC.
Figure 19:
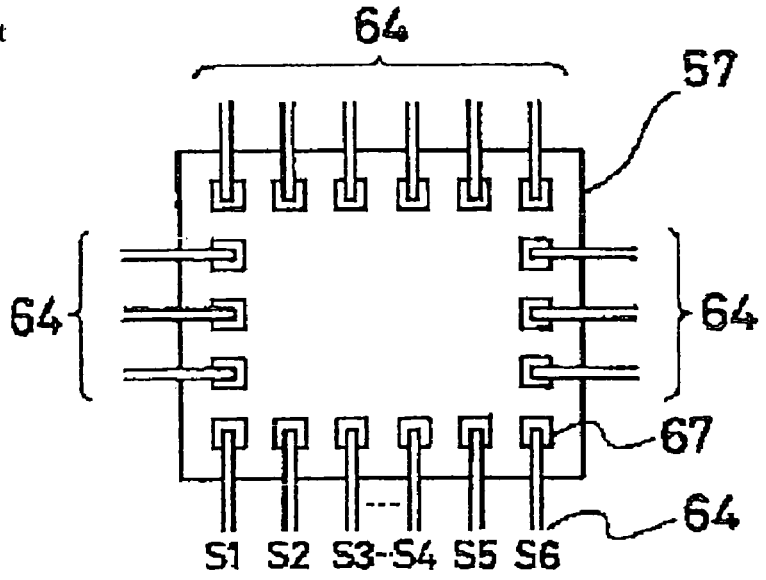
FIG. 19 Conventional Art
FIG. 19 is a plan view illustrating a portion where a conventional chip 57 and a TCP are connected with each other.
Figure 20:
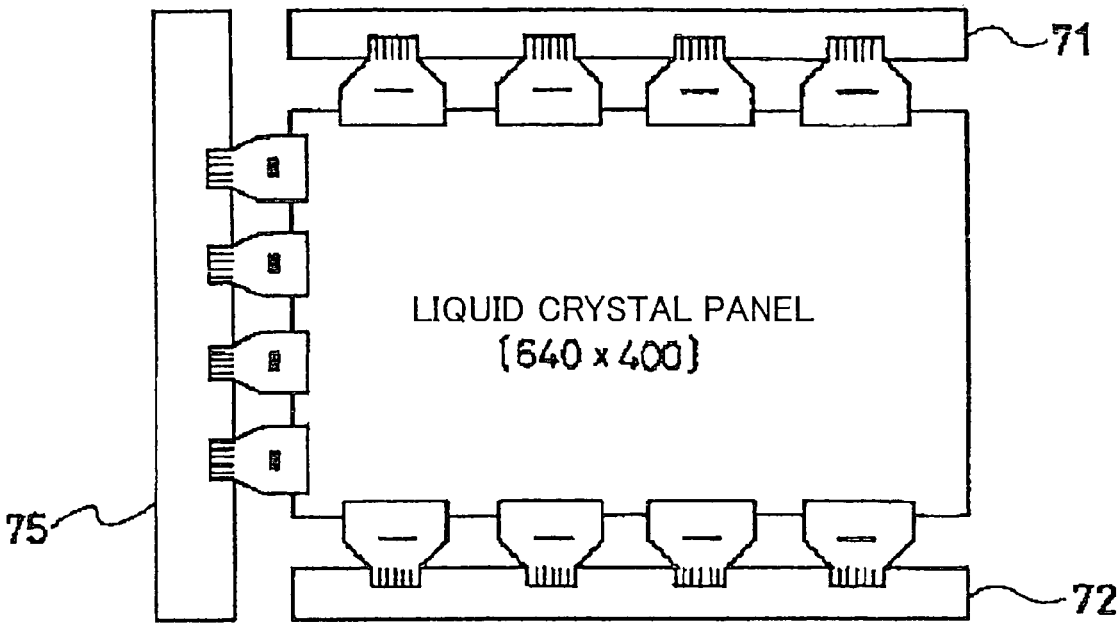
FIG. 20 Conventional Art
FIG. 20 is a plan view illustrating an arrangement of a conventional liquid crystal module.
Figure 21:
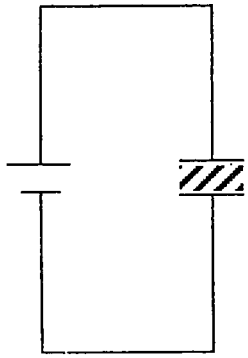
FIG. 21 (a) Conventional Art
FIGS. 21(*a*) and 21(*b*) are diagrams illustrating one example of basic methods of driving liquid crystal.
Figure 21:
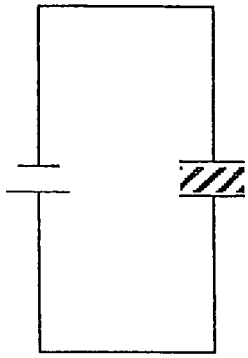
FIG. 21 (b) Conventional Art
Figure 22:
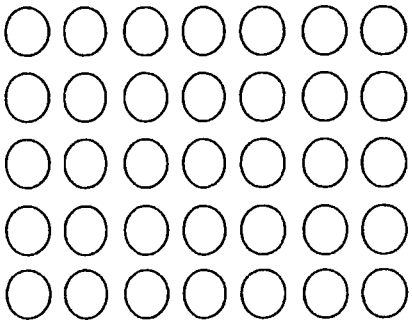
FIG. 22 (a) Conventional Art
FIGS. 22(*a*) and 21(*b*) are diagrams illustrating one example of various inversion driving methods.
Figure 22:
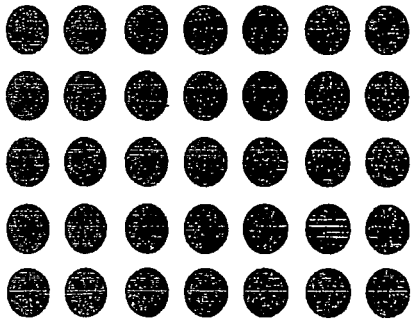
FIG. 22 (b) Conventional Art
Figure 23:
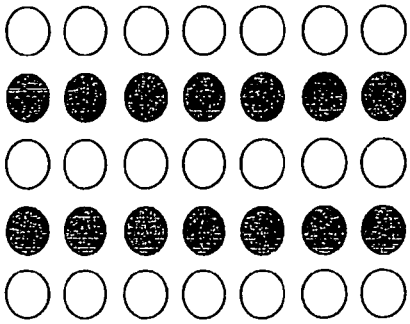
FIG. 23 (a) Conventional Art
FIGS. 23(*a*) and 23(*b*) are diagrams illustrating one example of various inversion driving methods.
Figure 23:
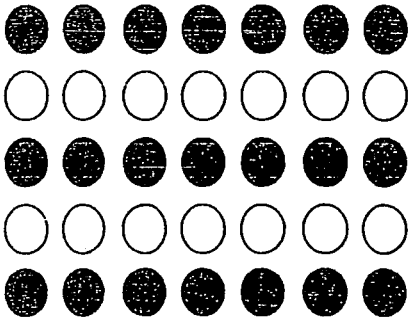
FIG. 23 (b) Conventional Art

FIG. 17 is another modified example of the present embodiment. In this arrangement, each image is displayed by the pixel group composed of two or more pixels. Here, the definition of "each image" is the same as above. In one horizontal period, at least one pixel of pixels in each of the pixel groups has a polarity opposite the polarities of other pixels in the pixel group of that one pixel. Moreover, all the pixels (R, G and B) in each pixel group are connected with each other via the short-circuiting switches 30*a* between the pixels. In the precharging, the short-circuiting switches 30*a* simultaneously turn ON/OFF.

That is, in one pixel group composed of pixels R, G and B, the polarities may be different from each other in the same horizontal period. For example, the pixels R and G in the first pixel group have positive polarities in a certain horizontal period, but the pixel B in the first pixel group has a negative polarity in the above horizontal period. For another example, the pixel R in the second pixel group has a negative polarity in a certain horizontal period, but the pixels G and B in the second pixel group have positive polarities in the above horizontal period. This can be realized easily by appropriately dephasing voltages applied to the source signal lines and the common electrode which are driven by alternating currents.

According to the arrangement illustrated in FIG. 17, all the pixels in a pixel group, that is, the pixels R, G and B can be short-circuited with each other by using the short-circuiting switches 30*a* each having three terminals.

The present invention is applicable to the liquid crystal display device and its driving device.

As described above, the driving device of the present invention drives a display section of a display device by applying, in each horizontal period, voltages to pixels in the display section through source signal lines charged to have source signal potentials according to display data signals supplied from an outputting circuit, the driving device precharging the source signal lines before causing the source signal lines to have the source signal potentials for the above each horizontal period, and the driving device comprises: a switching circuit which (a) separates the outputting circuit from the source signal lines and (b) short-circuits at least one source signal line whose source signal potential is positive in one horizontal period and at least one source signal line whose source signal potential is negative in the above one horizontal period, so that the short-circuited source signal lines are precharged.

According to the above arrangement, the precharging is carried out by short-circuiting (i) at least one source signal line whose source signal potential is positive and (ii) at least one source signal line whose source signal potential is negative in the same horizontal period.

In this way, the precharging is completed by short-circuiting the source signal lines with each other inside the display section. Therefore, the external memory capacitor is unnecessary, and the adjustment the external memory capacitor is obviously unnecessary. As a result, it is unnecessary to change or adjust the timing of the pulse width (high period) of the SELECT signal outputted from the controller. Therefore, it is unnecessary to renew the arrangement of the controller or produce the controller.

On this account, even when a newly designed display section (liquid crystal panel, etc.), which is different in the number of pixels and materials, is used, it is possible to realize a display device and a driving device which do not require the change in the arrangement of the controller.

Moreover, in addition to the above arrangement, the driving device of the present invention is so arranged that the source signal lines include R-signal lines, G-signal lines, and B-signal lines, which are connected to R-pixels, G-pixels, and B-pixels, respectively; and the switching circuit short-circuits an R-signal line with another R-signal line, a G-signal line with another G-signal line, and/or a B-signal line with another B-signal line, so that the short-circuited signal lines are precharged.

With the above arrangement, in the precharging, the short-circuiting is carried out between the source signal lines connected to pixels of the same color (R, G or B). In this way, the precharging of the source signal lines is carried out.

Therefore, in addition to the effect obtained by the above arrangement, it is also possible to carry out a desired precharging with a simple arrangement.

Moreover, in addition to the above arrangement, the driving device of the present invention includes a timing adjusting circuit which is able to adjust (i) a timing for separating the outputting circuit from the source signal lines and (ii) a timing for short-circuiting the source signal lines.

According to the above arrangement, it is possible to adjust (i) the timing of separating the outputting circuit from the source signal line and (ii) the timing of short-circuiting the source signal lines each other.

Therefore, in addition to the effect obtained by the above arrangement, it is also possible to easily adjust the timings of separating the above connection and short-circuiting, even when the design of the display section is changed.

Moreover, in addition to the above arrangement, the driving device of the present invention is so arranged that: each image is displayed by a pixel group including at least one pixel; through short-circuiting switches, each pixel in each pixel group is connected to at least one pixel in all the other pixel groups; and the short-circuiting switches are simultaneously turned on/off in the precharging.

With the above arrangement, each of the pixels in the pixel groups is connected to at least one pixel in the other pixel group so that the short-circuiting can be carried out.

Therefore, even when a certain pixel group is separated from the source signal lines, the other pixel groups do not lose their partner for the short-circuiting, and pixels in those other pixel groups are short-circuited with pixels in the other pixel groups without fail. Thus, even when the pixel groups are decreased from the existing source driver, it is possible to suppress generating display troubles, such as vertical lines, etc.

Moreover, in addition to the above arrangement, the driving device of the present invention is so arranged that pixels of the same color are connected with each other by the short-circuiting switches.

According to this arrangement, in addition to the effect obtained by the above arrangement, it is also possible to simplify the arrangement.

Moreover, in addition to the above arrangement, the driving device of the present invention is so arranged that, through bus lines and short-circuiting switches between the pixels and the bus lines, each pixel in each pixel group is connected to at least one pixel in all the other pixel groups.

According to this arrangement, in addition to the effect obtained by the above arrangement, it is also possible to simplify the arrangement.

Moreover, in addition to the above arrangement, the driving device of the present invention is so arranged that the switching circuit includes: short-circuiting switches each of which short-circuits an R-signal line with another R-signal line, a G-signal line with another G-signal line, or a B-signal line with another B-signal line, and separating switches each of which separates the outputting circuit from a source signal line so as to float the outputting circuit; each of the short-circuiting switches has one end connected to a source signal line and the other end connected to a common bus line shared by short-circuiting switches respectively connected to pixels of the same color; and precharging is performed by short-circuiting an R-signal line with another R-signal line, a G-signal line with another G-signal line, and/or a B-signal line with another B-signal line.

With the above arrangement, each of the pixels in the pixel groups is connected to at least one pixel in the other pixel group so that the short-circuiting can be carried out.

Therefore, even when a certain pixel group is separated from the source signal lines, the other pixel groups do not lose their partner for the short-circuiting, and pixels in those other pixel groups are short-circuited with pixels in the other pixel groups without fail. Thus, even when the pixel groups are decreased from the existing source driver, it is possible to suppress generating display troubles, such as vertical lines, etc.

Moreover, in addition to the above arrangement, the driving device of the present invention is so arranged that the short-circuiting switches and/or the separating switches are provided in the display section of the display device.

According to this arrangement, in addition to the effect obtained by the above arrangement, it is also possible to attempt to simplify the system.

Moreover, in addition to the above arrangement, the driving device of the present invention is so arranged that: each image is displayed by a pixel group including at least two pixels; in each pixel group, a polarity of at least one of the pixels is opposite a polarity of remaining pixels of the pixels in one horizontal period; and the pixels in each pixel group are connected with each other via the short-circuiting switches; and the short-circuiting switches are simultaneously turned on/off in the precharging.

With the above arrangement, each of the pixels in the pixel groups is connected to at least one pixel in the other pixel group so that the short-circuiting can be carried out.

Therefore, even when a certain pixel group is separated from the source signal lines, the other pixel groups do not lose their partner for the short-circuiting, and pixels in those other pixel groups are short-circuited with pixels in the other pixel groups without fail. Thus, even when the pixel groups are decreased from the existing source driver, it is possible to suppress generating display troubles, such as vertical lines, etc.

Moreover, the display device in accordance with the present invention is characterized by including the above-described driving device.

According to the above arrangement, the precharging is carried out by short-circuiting (i) at least one source signal line whose source signal potential is positive and (ii) at least one source signal line whose source signal potential is negative in the same horizontal period.

In this way, the precharging is completed by short-circuiting the source signal lines with each other inside the display section. Therefore, the external memory capacitor is unnecessary, and the adjustment the external memory capacitor is obviously unnecessary. As a result, it is unnecessary to change and adjust the timing of the pulse width (high period) of the SELECT signal outputted from the controller. Therefore, it is unnecessary to renew the arrangement of the controller or produce the controller.

On this account, even when a newly designed display section (liquid crystal panel, etc.), which is different in the number of pixels and materials, is used, it is possible to realize a display device and a driving device which do not require the change in the arrangement of the controller.

As described above, the driving device in accordance with the present invention includes the switching circuit which carries out the precharging of the source signal lines (i) by separating the outputting circuit from the source signal lines and (ii) by short-circuiting (a) at least one source signal line whose source signal potential is positive and (b) at least one source signal line whose source signal potential is negative in the same horizontal period. On this account, even when a newly designed display section (liquid crystal panel, etc.), which is different in the number of pixels and materials, is used, it is possible to realize a display device and a driving device which do not require the change of the arrangement of the controller.

The present invention is not limited to the embodiments above, but may be altered within the scope of the claims. An embodiment based on a proper combination of technical means disclosed in different embodiments is encompassed in the technical scope of the present invention.

What is claimed is:

1. A driving device for driving a display section of a display device by applying, in each horizontal period, voltages to pixels in the display section through source signal lines charged to have source signal potentials according to display data signals supplied from an outputting circuit, the driving device precharging the source signal lines before causing the source signal lines to have the source signal potentials for said each horizontal period, the driving device comprising:

a switching circuit configured to (a) separate the outputting circuit from the source signal lines and (b) short-circuit at least one source signal line whose source signal potential is positive in one horizontal period and at least one source signal line whose source signal potential is negative in said one horizontal period, such that the short-circuited source signal lines are precharged; and a timing adjusting circuit configured to adjust (i) a time period for separating the outputting circuit from the source signal lines and (ii) a time period for short-circuiting the source signal lines to prolong or shorten a duration of the short circuiting by adjusting a period of a hold signal, wherein the timing adjusting circuit at least includes:

a first signal generating circuit configured to generate a group of first signals from an inputted clock signal so as to count a number of pulses of the clock signal;

a pulse width signal adjusting circuit configured to compare the group of first signals with setting signals for setting a pulse width of an output signal to be supplied to the switching circuit; and an R-S flip flop circuit, wherein the R-S flip flop circuit is set based on the group of first signals and a hold signal, and reset by an output from the pulse width signal adjusting circuit, so as to output, to the switching circuit, an output signal with a desired pulse width.

2. The driving device as set forth in claim 1, wherein the source signal lines include R-signal lines, G-signal lines, and B-signal lines, which are connected to R-pixels, G-pixels, and B-pixels, respectively; and the switching circuit short-circuits an R-signal line with another R-signal line, a G-signal line with another G-signal line, and/or a B-signal line with another B-signal line, so that the short-circuited signal lines are precharged.

3. The driving device as set forth in claim 1, wherein:

each image is displayed by a pixel group including at least one pixel;

through short-circuiting switches, each pixel in each pixel group is connected to at least one pixel in all the other pixel groups; and the short-circuiting switches are simultaneously turned on/off in the precharging.

4. The driving device as set forth in claim 3, wherein pixels of the same color are connected with each other by the short-circuiting switches.

5. The driving device as set forth in claim 3, wherein through bus lines and short-circuiting switches between the pixels and the bus lines, each pixel in each pixel group is connected to at least one pixel in all the other pixel groups.

6. The driving device as set forth in claim 3, wherein the short-circuiting switches and/or the separating switches are provided in the display section of the display device.

7. The driving device as set forth in claim 1, wherein:

the switching circuit includes:

short-circuiting switches configured to short-circuit an R-signal line with another R-signal line, a G-signal line with another G-signal line, or a B-signal line with another B-signal line, and separating switches configured to separate the outputting circuit from a source signal line so as to float the outputting circuit, each of the short-circuiting switches includes a first end connected to a source signal line and a second end-end connected to a common bus line shared by short-circuiting switches respectively connected to pixels of the same color, and precharging is performed by short-circuiting an R-signal line with another R-signal line, a G-signal line with another G-signal line, and/or a B-signal line with another B-signal line.

8. The driving device as set forth in claim 1, wherein:

each image is displayed by a pixel group including at least two pixels;

in each pixel group, a polarity of at least one of the pixels is opposite a polarity of remaining pixels of the pixels in one horizontal period; and the pixels in each pixel group are connected with each other via the short-circuiting switches; and the short-circuiting switches are simultaneously turned on/off in the precharging.

9. The driving device as set forth in claim 1, wherein separation of the outputting circuit from the source signal lines is carried out simultaneously with short-circuiting of the source signal lines.

10. The driving device as set forth in claim 1, wherein the source signal lines are short-circuited after separation of the outputting circuit from the source signal lines.

11. A display device, comprising:

a driving device configured to drive a display section of a display device by applying, in each horizontal period, voltages to pixels in the display section through source signal lines charged to have source signal potentials according to display data signals supplied from an outputting circuit, the driving device precharging the source signal lines before causing the source signal lines to have the source signal potentials for said each horizontal period, the driving device including:

a switching circuit configured to (a) separate the outputting circuit from the source signal lines and (b) short-circuit at least one source signal line whose source signal potential is positive in one horizontal period and at least one source signal line whose source signal potential is negative in said one horizontal period, such that the short-circuited source signal lines are precharged; and a timing adjusting circuit configured to adjust (i) a time period for separating the outputting circuit from the source signal lines and (ii) a time period for short-circuiting the source signal lines to prolong or shorten a duration of the short circuiting by adjusting a period of a hold signal, wherein the timing adjusting circuit at least includes:

a first signal generating circuit configured to generate a group of first signals from an inputted clock signal so as to count a number of pulses of the clock signal;

a pulse width signal adjusting circuit configured to compare the group of first signals with setting signals for setting a pulse width of an output signal to be supplied to the switching circuit; and an R-S flip flop circuit, wherein the R-S flip flop circuit is set based on the group of first signals and a hold signal, and reset by an output from the pulse width signal adjusting circuit, so as to output, to the switching circuit, an output signal with a desired pulse width.

12. A driving device which applies voltages to pixels so as to drive a display section according to a dot inversion driving, the driving device comprising:

a precharging circuit configured to (i) separate an outputting circuit from data lines to which the outputting circuit outputs display data, and (ii) short-circuit at least two data lines, which are oppositely charged, of the display section so that said at least two data lines are precharged; and a timing adjusting circuit configured to adjust (i) a time period or separating the outputting circuit from the data lines and (ii) a time period for short-circuiting the data lines to prolong or shorten a duration of the short circuiting by adjusting a period of a hold signal, wherein the timing adjusting circuit at least includes:

a first signal generating circuit configured to generate a group of first signals from an inputted clock signal so as to count a number of pulses of the clock signal;

a pulse width signal adjusting circuit configured to compare the group of first signals with setting signals for setting a pulse width of an output signal to be supplied to the switching circuit; and an R-S flip flop circuit, wherein the R-S flip flop circuit is set based on the group of first signals and a hold signal, and reset by an output from the pulse width signal adjusting circuit, so as to output, to the switching circuit, an output signal with a desired pulse width.

13. The driving device as set forth in claim 12, wherein the precharging circuit includes:

short-circuiting switches configured to short-circuit the data lines; and separating switches configured to separate the outputting circuit from the data lines.

14. A display device, comprising:

a driving device configured to apply voltages to pixels so as to drive a display section according to a dot inversion driving, the driving device including:

a precharging circuit configured to (i) separate an outputting circuit from data lines to which the outputting circuit outputs display data, and (ii) short-circuit at least two data lines, which are oppositely charged, of the display section so that said at least two data lines are precharged; and a timing adjusting circuit configured to adjust (i) a time period for separating the outputting circuit from the data lines and (ii) a time period for short-circuiting the data lines to prolong or shorten a duration of the short circuiting by adjusting a period of a hold signal, wherein the timing adjusting circuit at least includes:

a first signal generating circuit configured to generate a group of first signals from an inputted clock signal so as to count a number of pulses of the clock signal;

a pulse width signal adjusting circuit configured to compare the group of first signals with setting signals for setting a pulse width of an output signal to be supplied to the switching circuit; and an R-S flip flop circuit, wherein the R-S flip flop circuit is set based on the group of first signals and a hold signal, and reset by an output from the pulse width signal adjusting circuit, so as to output, to the switching circuit, an output signal with a desired pulse width.

15. The driving device as set forth in claim 14, wherein the precharging circuit includes:

short-circuiting switches configured to short-circuit the data lines; and separating switches configured to separate the outputting circuit from the data lines.

* * * * *